US007475798B2

(12) United States Patent
van der Klaauw et al.

(10) Patent No.: US 7,475,798 B2
(45) Date of Patent: Jan. 13, 2009

(54) DEVICE AND METHOD FOR CONNECTING A PRESSURE SOURCE TO A CONTAINER

(75) Inventors: Guido Petrus Johannes van der Klaauw, Hilversum (NL); Bart Jan Bax, The Hague (NL); Marius Corstiaan van Duuren, Poortugaal (NL); Arie-Maarten Paauwe, De Lier (NL)

(73) Assignee: Heineken Technical Services B.V., Amsterdam (NL)

( * ) Notice: Subject to any disclaimer, the term of this patent is extended or adjusted under 35 U.S.C. 154(b) by 436 days.

(21) Appl. No.: 10/473,384

(22) PCT Filed: Apr. 2, 2002

(86) PCT No.: PCT/NL02/00213

§ 371 (c)(1),
(2), (4) Date: Mar. 1, 2004

(87) PCT Pub. No.: WO02/079075

PCT Pub. Date: Oct. 10, 2002

(65) Prior Publication Data

US 2004/0134939 A1 Jul. 15, 2004

(30) Foreign Application Priority Data

Mar. 30, 2001 (NL) ..... 1017742

(51) Int. Cl.
*B65D 83/00* (2006.01)

(52) U.S. Cl. ..... 222/400.7; 222/1; 222/153.14; 222/399; 222/509; 137/212

(58) Field of Classification Search ..... 222/1, 222/399, 400.7, 394, 400.8, 509, 153.14, 222/52, 56, 64; 137/212, 322
See application file for complete search history.

(56) References Cited

U.S. PATENT DOCUMENTS 3,976,221 A * 8/1976 Martin et al. ..... 222/61

(Continued)

FOREIGN PATENT DOCUMENTS

DE 95 558 C 1/1898

(Continued)

*Primary Examiner*—Frederick C. Nicolas
(74) *Attorney, Agent, or Firm*—Pearne & Gordon LLP

(57) ABSTRACT

An assembly of a container and a connecting device for connecting the container to a pressure source, wherein the container is provided with a tapping rod having therein at least one valve for releasing an input and/or output opening of the container, wherein the connecting device is provided with a housing with a first coupling and the container is provided with a metal outer casing with a cylindrical neck, which neck is secured by a first end on the outer casing and adjacent the opposite second end is provided with an outwardly extending second flange, which defines a second coupling for cooperation with the first coupling, wherein the tapping rod has been secured in the neck and wherein the neck, between the flange and first end, is substantially smoothly finished on the outside, and has a diameter that is smaller than the maximum diameter of the flange, the arrangement being such that in coupled condition of the connecting device and the container the second coupling is at least supported against the underside of the flange proximal to the first end of the neck, and the tapping rod is locked in the neck by at least the connecting device.

29 Claims, 18 Drawing Sheets

U.S. PATENT DOCUMENTS

| | | | | | |
|---|---|---|---|---|---|
| 4,026,316 | A | * | 5/1977 | Schots | 137/212 |
| 4,212,414 | A | * | 7/1980 | Beyens | 222/148 |
| 4,228,927 | A | * | 10/1980 | Beyens et al. | 222/148 |
| 4,305,421 | A | * | 12/1981 | Fallon | 137/322 |
| 4,450,853 | A | * | 5/1984 | Dessenoix et al. | 137/212 |
| 4,736,926 | A | * | 4/1988 | Fallon et al. | 251/149.9 |
| 5,176,298 | A | * | 1/1993 | Mogler et al. | 222/400.7 |
| 5,246,140 | A | * | 9/1993 | Thix et al. | 222/4 |
| 5,617,977 | A | * | 4/1997 | Augustinus | 222/400.7 |
| 5,636,657 | A | * | 6/1997 | Degenkolbe et al. | 137/212 |
| 5,657,911 | A | * | 8/1997 | Mogler et al. | 222/400.7 |
| 5,690,136 | A | * | 11/1997 | Celli | 137/212 |
| 6,223,955 | B1 | * | 5/2001 | Till | 222/400.7 |
| 6,315,172 | B1 | * | 11/2001 | Till | 222/400.7 |
| 6,367,667 | B1 | * | 4/2002 | Ipsen | 222/400.7 |

FOREIGN PATENT DOCUMENTS

| | | | |
|---|---|---|---|
| DE | 91 09 177 | U | 10/1991 |
| DE | 295 19 783 | U | 10/1996 |
| EP | 0 759 409 | A | 2/1997 |
| GB | 2 061 874 | A | 5/1981 |
| GB | 2 346 613 | A | 8/2000 |
| WO | WO 00 35773 | A | 6/2000 |

* cited by examiner

DEVICE AND METHOD FOR CONNECTING A PRESSURE SOURCE TO A CONTAINER

This invention relates to an assembly of a container, a pressure source and a connecting device according to the preamble of the main claim. Such an assembly is known from practice and is used, for instance, for dispensing carbonated beverage such as beer.

This known assembly comprises, for instance, a beer keg, a $CO_2$ cylinder and a connecting device. The $CO_2$ cylinder contains $CO_2$ under high pressure and is connected via a gas tube with the connecting device, whilst a reducing valve is fitted on the cylinder for reducing the gas pressure. In addition, to the connecting device a beverage dispensing tube is connected which is in communication with a tapping device. The connecting device is provided with bayonet-shaped coupling means which can be fitted in the collar of the tapping rod of the container and can cooperate therein with complementary coupling means for coupling the connecting device to the container. Within the collar, a valve of the container is provided. The connecting device is provided with a pivoting handle with which a pin can be pressed down for pressing the valve open. A fluid communication is thereby released between, on the one hand, the gas tube and the interior of the container and, on the other, the interior of the container and the beverage dispensing tube. Upon opening of the tapping device, beverage is thereupon dispensed from the container as a result of $CO_2$ as pressure medium introduced under pressure into the container.

This known assembly has as a disadvantage that it takes relatively much force to open the valve with the handle. Moreover, there is a risk that the connecting device has not been properly fitted on the container, so that it may become detached when the handle is depressed, as a result of the closing force exerted on the valve. This may be hazardous to a user who operates the connecting device, since he has his hands, and possibly other parts of the body, such as his face, close to the connecting device. A further disadvantage of the known assembly is that the tapping rod, together with the connecting device, may become detached from the container, specifically because the tapping rod has been screwed into the neck of the container and the connecting device is secured through a turning movement. This may give rise to particularly dangerous situations.

The object of the invention is to provide an assembly of the type described in the preamble, wherein the above-mentioned disadvantages of the known assembly are avoided, while maintaining the advantages thereof. To that end, an assembly according to the invention is characterized by the features according to claim 1.

In an assembly according to the invention, the coupling means of the connecting device engage the neck of the container instead of the tapping rod. This means that a particularly safe locking of the tapping rod is obtained as well as a large engagement surface for the connecting device. Relatively great forces and moments can thus be absorbed. Further, an advantage thus achieved is that the connecting device in principle does not need to be fitted in a specific position from above anymore. The coupling means can be simply made of orientation-independent construction, at least with respect to the longitudinal axis of the container, in particular of the neck. Thus, placement is facilitated still further.

In an assembly according to the invention, the first and second coupling means can be made of simple design, in principle independent of the tapping rod used, so that a greater range of application and a greater flexibility are obtained.

A further advantage of such an assembly is that the space between the lugs in the tapping rod conventionally used for securing the connecting device and the valves remains clear, for instance for receiving an intermediate body for operation of the valves and/or discharge of the beverage.

In an advantageous embodiment, an assembly according to the invention is characterized by the features according to claim 6.

In such an embodiment, the connecting device, at least the opening of the valve of the container, is controlled by the pressure medium. This means that connection and operation of the valve requires particularly little force on the part of the user and moreover the valve can be safely opened and closed. Any risk of injury to the user is thereby eliminated substantially completely. A further advantage thereof is that the container can only be opened when sufficient pressure medium with sufficient pressure is present. This prevents undesired opening of the container, so that the quality of the fluid to be dispensed, such as liquid, gas or powder, while in the container and when being dispensed is maintained.

It is preferred that the input means comprise pressure regulating means for reducing a control pressure to a regulating pressure, in particular a relatively constant regulating pressure, independent of the control pressure. Thus a connecting device is obtained which can be connected with only one supply line, while at all times a desired pressure in the container is maintained, during use.

In a further advantageous embodiment, an assembly according to the invention is further characterized by the features according to claim 10.

In such an embodiment, the advantage is achieved that when the connecting device has not been secured, at least improperly so, on the container, the piston, upon energization, will be moved beyond the second position into the third position, thereby preventing gas from escaping to the surroundings. Indeed, in the third position the input means are closed off (again).

In a further advantageous embodiment, an assembly according to the invention is further characterized by the features according to claim 13.

In such an assembly, first and second coupling means are provided for coupling the operating device with the container, while the first and/or second coupling means are operable with the aid of pressure medium, for obtaining the desired clamping for those coupling means. As a result, connecting the container is enabled in a still simpler and safer manner.

It is preferred that in an assembly according to the invention a dispensing line is connected with the container, through which a fluid can be dispensed from the container, to which end the regulating pressure in the container is set. Preferably, the dispensing line is then in fluid communication with the interior of the container, while contact between the fluid and the connecting device is avoided entirely. The dispensing line is preferably connected with the container so as to be supplied and removed along with it, so that only the or each pressure medium line is connected with the connecting device. Cleaning such a connecting device is thus enabled in a particularly simple manner and only needs to be done infrequently.

The invention further relates to a connecting device for a pressure source for pressure medium onto a container, characterized by the features according to claim 14.

Such a connecting device is particularly advantageous because it requires substantially no operating force of a user and enables connection in a simple manner.

The invention further relates to a method for connecting a container to a pressure source, characterized by the features according to claim 19.

With such a method, in a particularly simple manner, a container can be connected, without this requiring undesirably much force or precision from the user.

Further advantageous embodiments of an assembly, connecting device and method according to the invention are further described in the subclaims.

To clarify the invention, exemplary embodiments of an assembly, connecting device and method according to the invention will be further elucidated with reference to the drawing. In the drawing.

Figure 1:
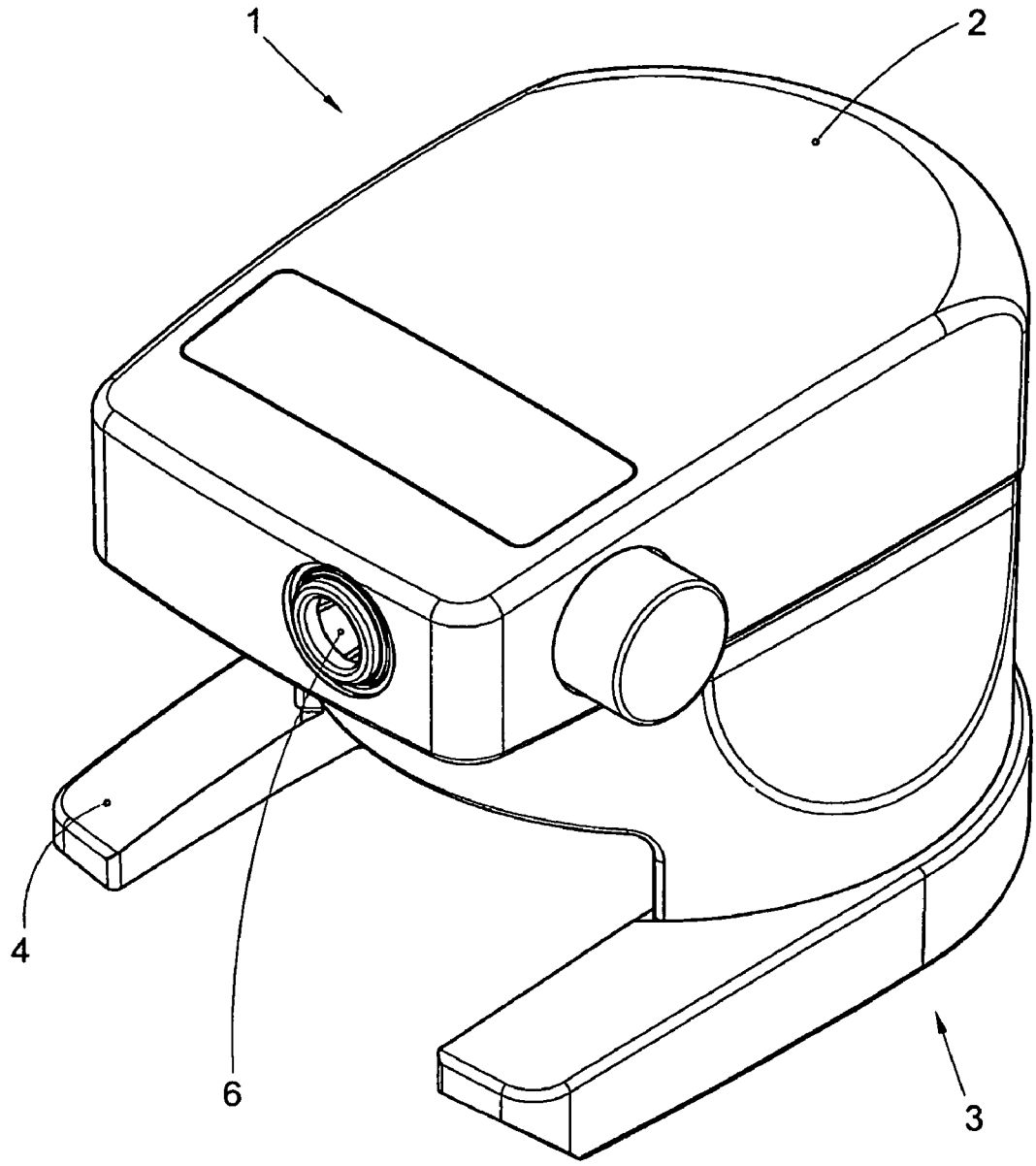
FIG. 1 shows in perspective view a connecting device according to the invention.

In this description, the same or corresponding parts have the same or corresponding reference characters. In FIGS. 1-6, a connecting device according to the invention is shown, while FIGS. 7-16 show an assembly of a connecting device according to the invention, a container such as a beer keg and, schematically, a pressure source for a pressure medium. In FIGS. 7, 8 and 10-16, there is fitted in the neck of the container a dispensing device A, to which a line B is attached for dispensing a fluid such as beer from the interior C of the container D. An assembly of such a container D and dispensing device A, as well as the valve E are described in the non-prepublished Dutch patent application, filed by applicant, entitled "Tapping rod" (NL 1016687), which is understood to be incorporated herein by reference, in particular as regards the container, valve and dispensing device for cooperation with a connecting device according to the invention.

In the embodiments described and shown in the drawing, in each case a container D is shown, having a neck 200 mounted by a first end 201 thereof in the container D, preferably through welding technique. The neck 200 is substantially cylinder-shaped and provided at the opposite second end 202 with the outwardly extending collar or flange 5 on which the connecting device can be fitted. The flange 5 then preferably defines the greatest diameter P of the neck 200, such that the connecting device 1 has a maximum engagement surface, a standard tapping rod F with valve(s) E can be screwed into it, and relatively little material is needed. The neck 200, under the flange 5, at least between the flange 5 and the transition to the container D, is finished preferably relatively smoothly on the outside, so that cleaning is readily possible and standard filling and cleaning devices can be used. By securing the connecting device on the collar or flange 5 of the neck 200, and not, as in the prior art, in the tapping rod F, the possibility of the tapping rod F becoming unintentionally detached from the container D, which is dangerous because of the pressure, is prevented in a simple manner. Any profiles on the outer side of the neck 200 are chosen so as to be simply cleanable, for instance wide, shallow grooves. Preferably, however, the outer side of the neck 200 is free of grooves, ribs and the like.

Figure 7:
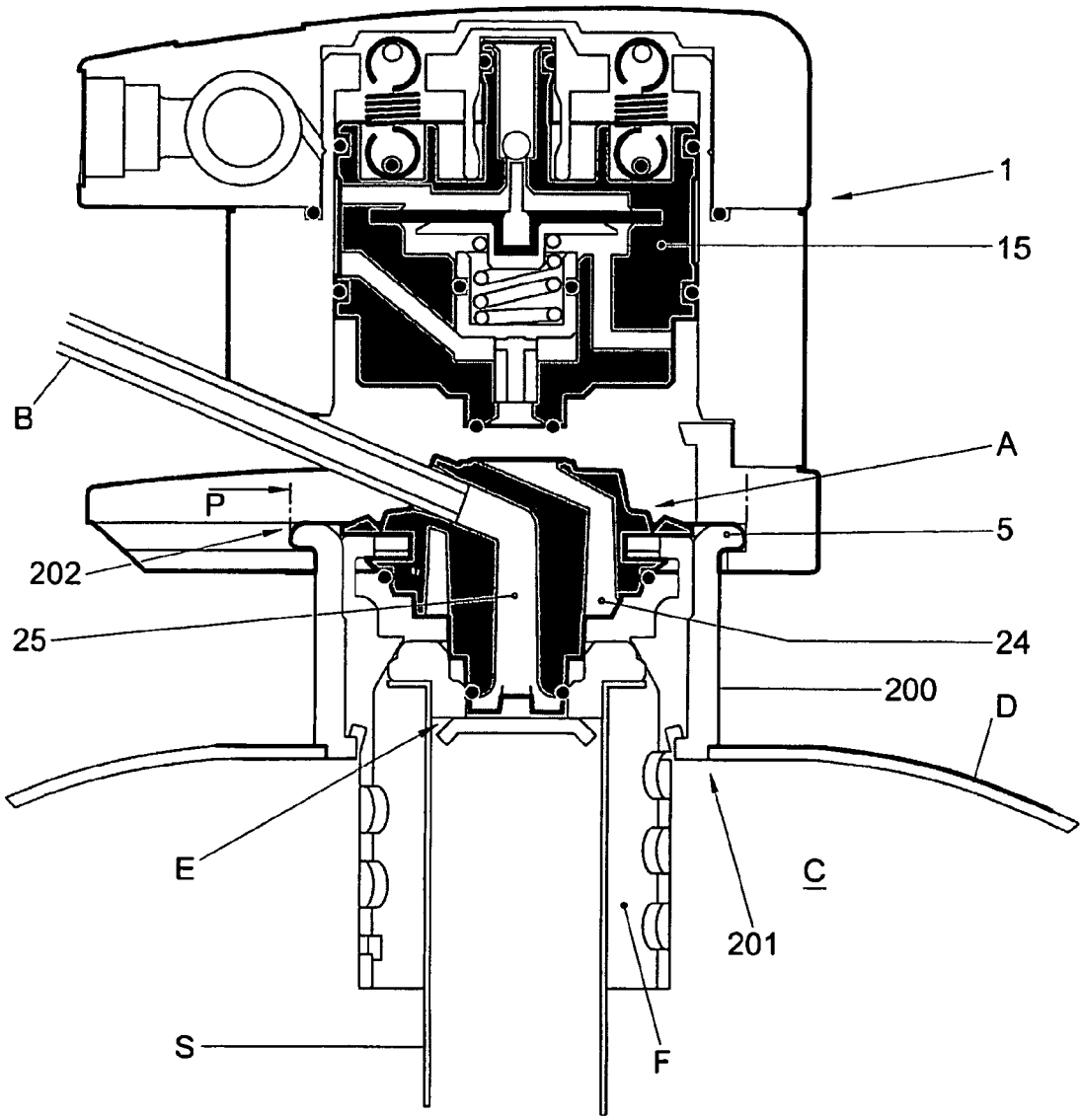
FIG. 7 shows a connecting device according to FIG. 1, in a view similar to FIG. 3, fitted on a beer container with conventional valve.

FIG. 1 shows in perspective view a connecting device 1 according to the invention, comprising a housing 2 having adjacent an underside 3 thereof a substantially horseshoe-shaped shoe 4 which, as shown, for instance, in FIG. 7, can be fittingly slipped over a collar 5 of a container D, for coupling same. Shoe 4 and collar 5 then constitute first and second coupling means. At the front of the connecting device 1, a rapid coupling 6 is provided for connecting a supply line of a pressure source, for supplying a pressure medium under a relatively high control pressure, as will be elucidated further hereinafter.

Figure 2:
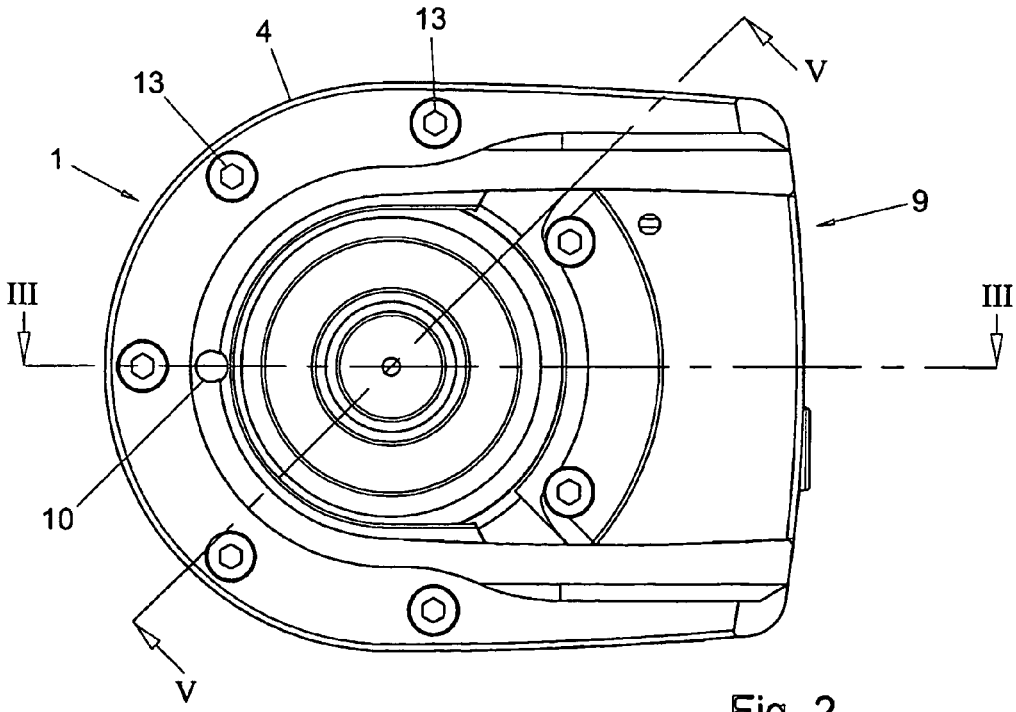
FIG. 2 shows in bottom view a connecting device according to FIG. 1.

FIG. 2 shows the connecting device 1 according to FIG. 1 at the underside, clearly visualizing the somewhat horseshoe-shaped shoe 4, which comprises a slot 8 which can be slipped over the collar 5. Opposite the open side 9 a spring-loaded ball 10 is provided which functions as stop. When the connecting device 1 has been moved over the collar 5 to a maximum, the ball 10 is forced over the edge of the neck of the container D, so that a tactile signaling of the desired position is obtained. Optionally, this ball can be coupled, for instance electrically, pneumatically or mechanically, to means for the release of means for operating the connecting device 1.

In an alternative embodiment, adjacent the input side for the collar 5, in or adjacent the slot 8, springing or elastic means such as the ball mentioned, pivoting arms, elastic cams or the like, are provided, for locking the collar and/or as an indication of the correct coupling position. These means are then preferably disposed such that in the slide-in direction of the collar, behind those means, more than half of the collar can be locked, for instance adjacent the rightmost bolts 13 in FIG. 2, adjacent the open side 9.

The housing 2 comprises a central part 11 and an upper part 12. The shoe 4, the central part 11 and the upper part 12 have been secured onto each other using a series of bolts 13. In the central part 11, a chamber 14 is recessed, which reaches into the upper part 12. In the chamber 14, an axially movable piston 15 is received, arranged for operation of the valve E, at least axial movement of the dispensing device A for operation of that valve E. The chamber 14 is substantially closed off at the upper end by an end wall 16, in which two springs 17 have been secured, which are connected with the upper end of the piston 15, for biasing the piston 15 in an upper, first position, as shown in FIG. 3.

Figure 3:
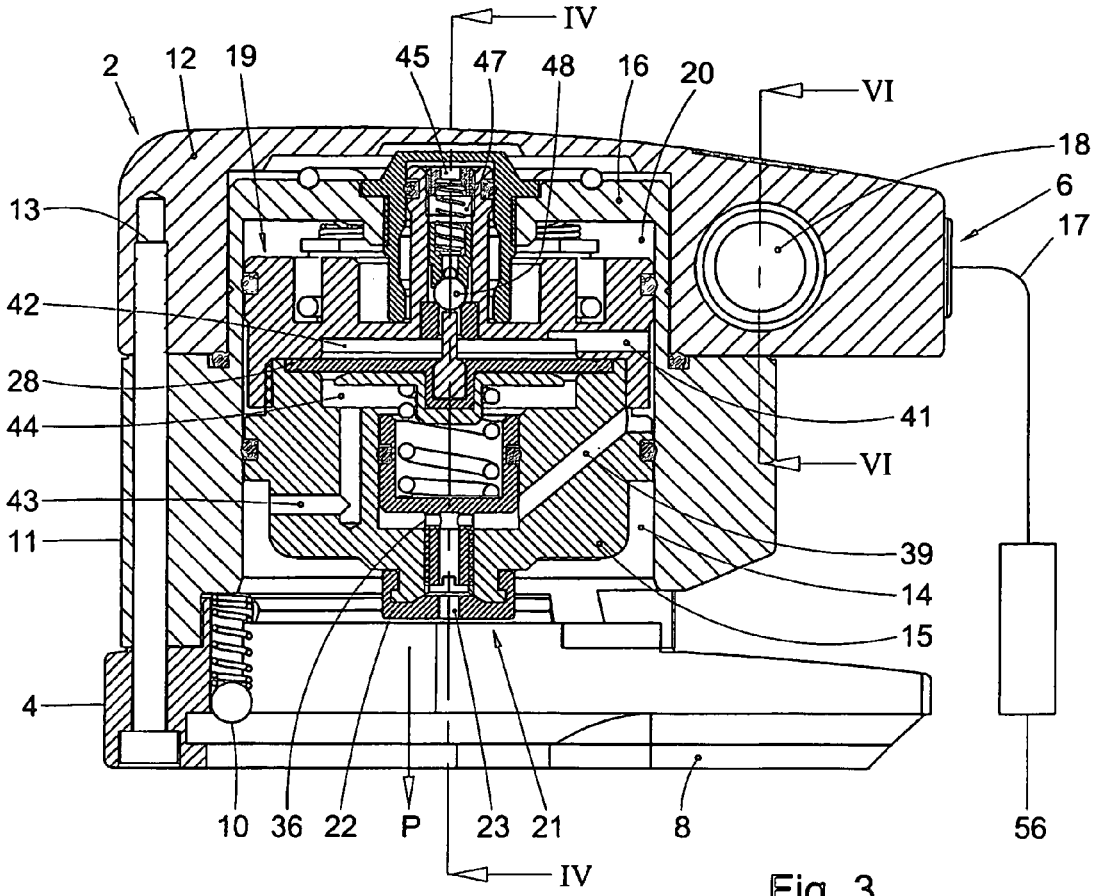
FIG. 3 shows the connecting device according to FIG. 1 in a cross sectional view taken along the line III-III in FIG. 2.

FIG. 3 schematically shows a supply line 17, coupled to the connecting means 6. In the upper part 12, an operating means 18 is provided, shown in more detail in FIG. 6, which operating means 18 will be further described hereinafter. In a general sense, a connecting device 1 according to the invention is so designed that after operation of the operating means 18, a fluid communication is released between the supply line 17 and a pressure chamber 20 enclosed between the end wall 16 and the upper side 19 of the piston 15. Via this fluid communication, a pressure medium, in particular $CO_2$, is introduced into the chamber 20 under a relatively high pressure (control pressure), so that the piston 15 is axially moved down, in the direction of the arrow P. In a position when fitted on a container B, as shown, for instance, in FIG. 7, the piston 15 moves by the lower end 21 thereof, in particular by a flexible cap 22 arranged at that point, with passage opening 23, against the connecting device A, which is thereby pressed down. As a result, the valve E is opened, so that pressure medium, in particular $CO_2$, which can flow in a manner to be further discussed hereinafter from the chamber 20 to the passage opening 23, can flow through a gas channel 24 into the interior C of the container D. Liquid, in particular beverage such as beer, can then flow from the interior C through a riser S along the valve E into a beverage channel 25 of the dispensing device A and thence through the dispensing line B. If the gas pressure in chamber 20 is removed, for instance through closure of the operating means 18, gas can flow out of the chamber 20 and the piston 15 will be pulled back up by the springs 17, from the second position just described, in which the valve E is open, to the first position described earlier, in which the valve E is closed.

In the exemplary embodiment shown, the piston 15 is substantially built up from a lower piston part 25 and an upper piston part 26, which piston parts have been screwed onto each other via screw thread connection 27. Included between the two piston parts 25, 26 is a substantially sheetlike membrane 28 which in the starting position shown is substantially planar and is carried by a supporting dish 29. Arranged in the lower piston part 25 is a cylindrical chamber 30, open in the direction of the upper piston part 26, in which piston chamber 30 an inner piston 31 is arranged, which can move axially. The inner piston 31 has a hollow upper part 32 and a pin-shaped lower part 33, which is likewise of hollow design, with a closed end proximal to the upper inner piston part 32. In the upper part 32 a compression spring 34 is supported, which rests against the dish 29. The pin-shaped part 23 reaches into a channel 35 which connects the piston chamber 30 with the passage opening 23. Provided in the end located adjacent the upper inner piston part 32 are openings 36, which connect the hollow inside 37 of the pin 33 with the piston chamber 30, under the upper inner piston part 32. From a point adjacent the bottom 38 of the piston chamber 30 extends an inclined channel 39 which terminates right under the screw thread 27 in the outer wall of the lower piston part 25, above a lower packing ring 40, forming a sealing between the piston 15 and the wall of the chamber 14. The inclined channel 39 is in fluid communication, along the inner wall of the chamber 14, with an upper channel 41, which connects the inclined channel 39 with a pressure chamber 42 above the membrane 28. Further, in the lower piston part 25 a breather channel 43 is provided which connects a chamber 44 in which the dish 29 is accommodated, under the membrane 28, with the surroundings. As a result, chamber 44 remains at ambient pressure. The inner piston 31 is sealed, by way of a packing ring, against the wall of the piston chamber 30.

Provided centrally in the upper piston part 26, next to the upper channel 41, is a main channel 45, which extends axially upwards and which, adjacent the lower end, via a reduced part 46, is in fluid communication, at least can be so communicated, with pressure chamber 42. From the membrane 28 extends a plunger pin 47 in the reduced part 46, whose free end in the first position lies adjacent the end of the reduced part 46. In the wider part 47 of the main channel 45, a ball 48 is arranged, which in principle can move freely through the main channel 45 and can be struck by the plunger pin 47 off the seat 60 formed by the end of the reduced part 46. If the ball 48 is on the seat 60, the fluid communication between the main channel 47 and the pressure chamber 42 is broken. Instead of ball 48, any other suitable shape of a closing body can be used, for instance (truncated) cone-shaped, rounded block-shaped, pyramidal and like closing bodies known per se.

Figure 4:
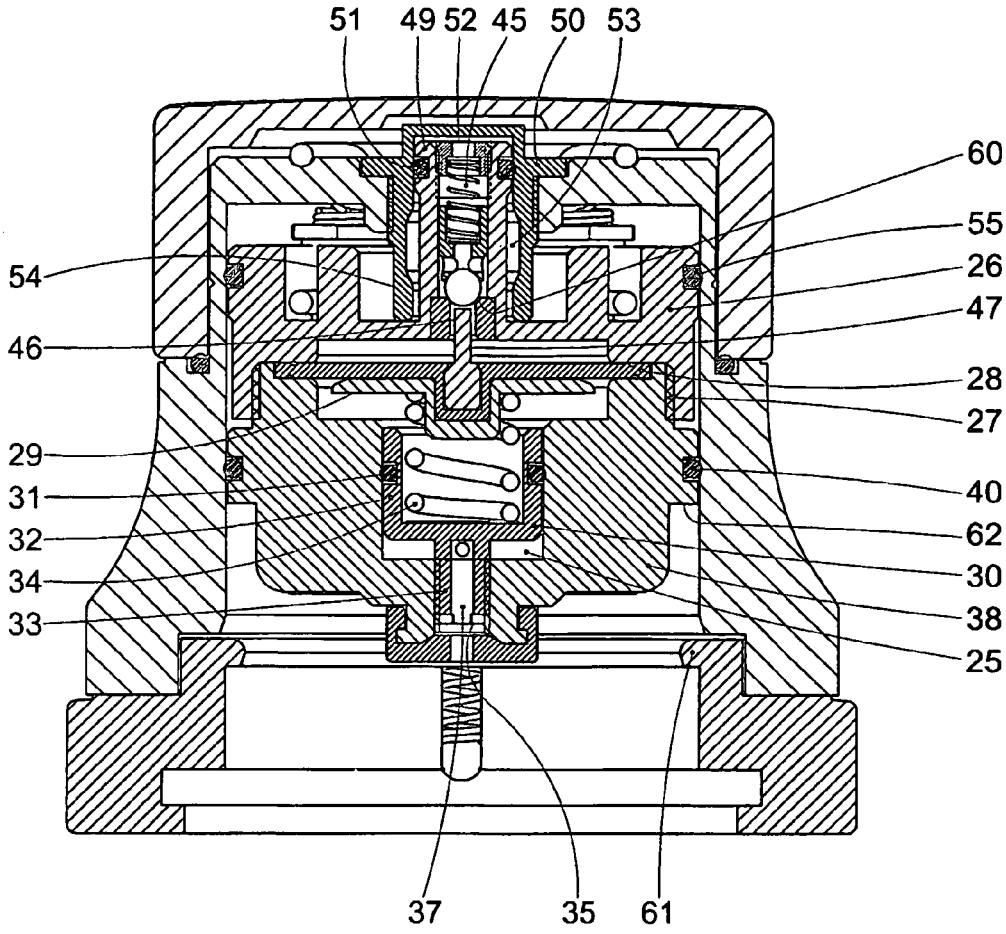
FIG. 4 shows the connecting device according to FIG. 1 in a cross sectional view taken along the line IV-IV in FIG. 3.
Figure 5:
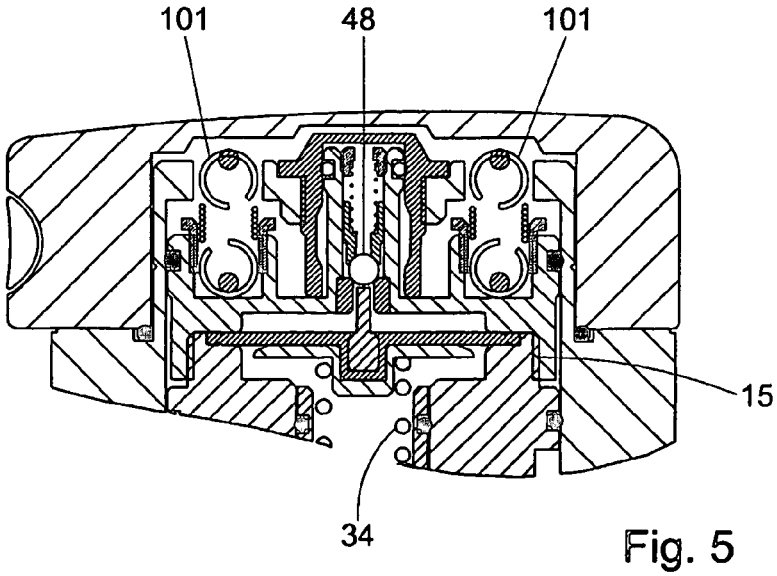
FIG. 5 shows the upper part of a connecting device according to FIG. 1 in a cross-sectional view taken along the line V-V in FIG. 2.

The main channel 45 is surrounded by a cylindrical wall 49 and in the position shown in FIGS. 3 and 4 is open in upward direction. The cylindrical part 49 extends into a substantially cylindrical casing 50. Adjacent the open upper end, on the outside of the cylindrical part 49, an end packing 51 is arranged, in the form of an O-ring. The casing 50 is closed above the free end by an end wall 52, and on the inside proximal to the cylindrical part 49 is provided with a widening 53. Above and below the widening 53, the cross section on the inside of the casing 50 has been selected such that the O-ring 51 can be in sealing gas-tight engagement therewith. In the first position the open end 54 of the casing facing downwards in FIG. 4 lies approximately against a wall of the pressure chamber 42, with the open end of the cylindrical part 49 situated near the end wall 52. A fluid communication between the widening 53 and the main channel 45 is therefore closed off by the O-ring 51. The widening 53, however, is in fluid communication with the chamber 20. Arranged around the upper piston part 26 is an upper packing 55, in sealing engagement with the inner wall of the chamber 14, such that a fluid communication between the chamber 20 and the upper channel 41 other than via the main channel 45 is closed at all times.

A connecting device 1 according to FIGS. 1-5 can be used as follows.

The connecting device 1 is secured, in the first position, by the shoe 4 as described earlier, onto the collar 5 of a container B, whereafter the operating device 18 is operated and a pressure medium is introduced from a pressure source 56 such as a $CO_2$ bottle via the supply line 17 along the operating device 18 into the chamber 20, under a control pressure, for instance 3 to 4 bars (4 to 5 bars absolute). Due to the packing 51 closing off the fluid communication to the main channel 45, pressure is built up in the chamber 20, as a result of which the piston 15 is pressed in the direction away from the end wall 16, axially in the direction P, to a second position, in which the valve E is opened by the dispensing device A. Through this movement, the O-ring 51 moves down with the cylindrical part 49, away from the end wall 52 of the casing 50, such that the O-ring 51 is moved into the widening 54. This concerns substantially the second position. In this second position, pressure medium can flow from the chamber 20 between the casing 50 and the cylindrical part 49 into the widening 54 along the packing 51 and thence into the main channel 45. The ball 48 is pressed by the plunger pin 47 off the seat 60 to some extent, so that a fluid communication arises between the main channel 45 and the pressure chamber 42. Then pressure medium can flow from the pressure chamber 42 into the inclined channel 39 and thence through the openings 36 to the passage opening 23 and then into the interior C of the container D along the valve E. As a result, in the container C, a regulating pressure of, for instance, 1.7 bars absolute is obtained for delivering liquid along the valve E and through the beverage channel 25 and the dispensing channel B. The interior work of the piston 15 here functions as an automatic pressure regulation with which the control pressure of the pressure medium in the chamber 20 can be reduced to a pre-set regulating pressure of the pressure medium which is introduced into the interior. This can be understood as follows.

The pin-shaped part 33 of the inner piston 30 is provided with screw thread through which it has been screwed into complementary screw thread in the channel 35. By screwing this pin 33 into the channel 35 to a greater or lesser extent, the bias in the spring 34 is set, so that the membrane 28 is biased upwards to a greater or lesser extent, that is, in the direction of the main channel 45. If the piston 15 is moved to the second position, pressure medium will flow into the pressure chamber 42 and thereby exert pressure on the upper side of the membrane 28. Upon increasing pressure in the pressure chamber 42, the membrane 28 with the dish 29 is moved further and further down, that is, in the direction of the inner piston 30, against the spring force of the spring 34. According as the membrane 28 moves further down, the plunger pin 47 can move along in downward direction, as a result of which the ball 48 is pressed further in the direction of the seat 60 until this ball 48 is in fully sealing engagement with the seat 60. Then the desired regulating pressure in the pressure chamber 42, at least in the interior of the container C, has been achieved. If liquid is dispensed from the interior C or if the pressure therein decreases further by any other cause, then also the pressure in the pressure chamber 42 will decrease, so that the membrane 28 will be moved upwards to some extent again by the spring pressure of the spring 34, thereby pressing the ball 48 off the seat 60 with the plunger pin 47. In that condition, again, pressure medium can be introduced from the chamber 20 through the pressure chamber 42 into the container D. In this way, the desired regulating pressure in the container D can be maintained at all times. Surprisingly, it has been found that this enables a particularly accurate regulation.

In the embodiment shown, as described earlier, under the widening 54, the casing 50 is again made of such narrow design that the O-ring 51 is capable of sealing engagement therewith. The advantage thereby achieved is that when the operating means 18 is energized without the connecting device 1 being fitted on a container D, the piston 15 is moved beyond the second position to a third position, wherein the O-ring 51 is in sealing engagement with said part of the casing 50 under the widening 53. The fluid communication between the chamber 20 and the passage opening 23 is then closed off again, so that no pressure medium can flow to the surroundings. An inwardly reaching edge 61 of the shoe 4 then ensures that the piston 15 cannot move beyond the lower, third position, with an edge 62 of the lower piston part 25 abutting against that edge 61. In the third position, too, it holds that when the pressure of the pressure medium is removed, for instance by pressing the operating means 18 shut, the piston 15 is pulled back into the first position by the springs 17.

Figure 6:
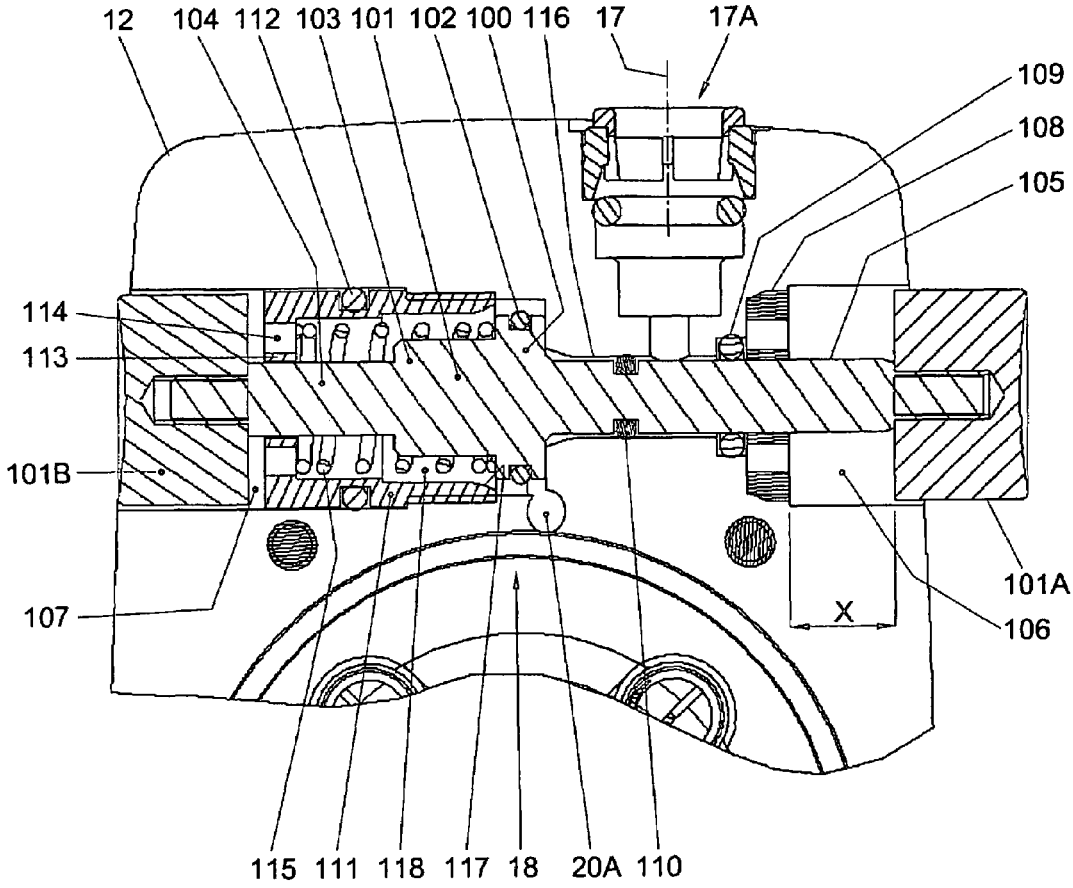
FIG. 6 shows in cross-sectional view taken along the line VI-VI in FIG. 3 a portion of a connecting device according to FIG. 1.

FIG. 6 shows in cross-sectional top plan view a portion of an operating device 1 according to the invention with operating means 18. Clearly visible are connecting means 17A, in particular rapid-coupling means for a supply line 17, schematically represented by a chain-dotted line. Further shown is a passage line 20A for connecting the operating means 18 with the chamber 20, for feeding a pressure gas into it. Included between the passage line 20A and the connecting means 17A is a movable shaft 101, on which on the right-hand side in FIG. 6 a first knob 101A is fitted, with a second knob 101B on the opposite side. The knobs 101 are accessible from the outside. Provided in the housing 12 is a bore through which extends the shaft 101. Adjacent a middle of the housing 12, the shaft 101 is provided with an outwardly extending flange 100 with a packing 102 thereon. On the left side of the flange 100, the shaft comprises a first part 103, reduced with respect to the flange 100, and, adjacent thereto, a further reduced second part 104. On the opposite side of the flange, the shaft 101 is provided with a reduced third part 105. The second and third parts 104, 105 have approximately the same cross section. The third part 105 reaches into a first knob chamber 106; the opposite second part 104 reaches into a second knob chamber 107. The length of the shaft 101 has been selected such that this shaft can move axially over a distance X. In the bottom of the first knob chamber 106, a closing ring 108 is fitted, for instance screwed, which locks a second packing 109, which second packing 109 is in sealing engagement with the third part 105. On the third part 105, a third packing 110 is arranged, approximately centrally between the first packing 102 and the second packing 109. From the second knob chamber 107 a sleeve 111 has been screwed into the housing 12, which sleeve is provided on the outside with a fourth packing 112, so that a gas-tight sealing is obtained. The sleeve 111 is provided, on the side remote from the flange 100, with an end wall 113 with holes 114 against which a spring 115 is supported, which has its opposite ends resting against the flange 100 and has been slipped over the first part 103 of the shaft 101. As a result, the shaft 103 is biased into the position moved to the right, shown in FIG. 6. The connecting means 17A terminate in the bore 116, between the second packing 109 and the third packing 110, so that in this condition gas that is supplied via the connecting line 17 cannot pass the two packings 109, 110. The sleeve 111 is provided, on the side proximal to the flange 100, with a sloping run-in edge 117 and is provided with an inner bore 118 whose diameter has been selected such that the first packing 102 can be in sealing gas-tight engagement therewith. The spring 115, in particular the spring characteristic thereof, has been selected such that it can be balanced with a gas pressure supplied via supply line 17, in the following manner.

In the condition shown in FIG. 6, the communication between the connecting means 17A and the passage line 20A is closed by the third packing 110. When the knob 101A is operated, the shaft 103 is moved to the left, in FIG. 6, against the spring pressure of the spring 115. First, the first packing 102 is thereby moved into the inner bore 118, before the third packing 110 moves out of the bore 116. Then, gas can flow via the supply means 17A through the bore 116 along the third packing 110 to the supply line 20A. Such a gas pressure is thereby exerted on the flange 100 that at least an equilibrium exists between said gas pressure and the spring pressure. If the gas pressure falls below a pre-selected value, for instance less than 2 bars absolute, which value, of course, is mentioned solely by way of example and should not be construed to be limitative, the gas pressure will be insufficient to resist the spring pressure. In that case, the shaft 103 is again shifted to the right, whereby first the third packing 110 is moved back into sealing cooperation in the bore 116 again, whereafter the first packing 102 moves out of the inner bore 118 of the sleeve 111 and an open communication is formed between the channel 20A and the surroundings, via the opening 114 and along the left knob 101B. The chamber 20 is thereby vented, so that the piston 15 will move back up and the valve of the container will be closed. Of course, the shaft 101 can also be moved manually to the right, that is, to the closed position. It will be clear that by screwing the sleeve 111 to a greater or lesser extent into the second knob chamber 107, the spring pressure of the spring 115 can be set, so that the equilibrium pressure between the spring on the one hand and the gas pressure on the other can be set to a desired value.

An operating device 18 can also be designed for remote operation, for instance by connecting electromagnetic, pneumatic or like means to the shaft or by replacing same with remotely operable valve means, preferably provided with overpressure and/or underpressure safety means. Such an embodiment is suitable in particular for use with a device according to FIG. 19.

FIG. 7 schematically shows in sectional side elevation a connecting device 1 according to the invention, with the piston 15 in the first position, above a dispensing device A in the neck of a container D. In this embodiment, the dispensing device A is designed as a one-piece dispensing device. An advantage of this embodiment is that the connecting device 1 can be fitted and removed without this requiring the dispensing device A to be carried along. The dispensing device A can for instance be designed for single use. The connecting device 1 then does not require cleaning, at least requires relatively little cleaning.

In FIG. 8, again in a sectional side elevation, a connecting device 1 according to the invention is shown, mounted on a neck of a container D, above a dispensing device A with dispensing tube B, fitted therein. In this embodiment, the dispensing tube B extends approximately horizontally. As already indicated, these dispensing devices A are described in detail in applicant's earlier-mentioned non-prepublished Dutch patent application, incorporated herein by reference.

Figure 8:
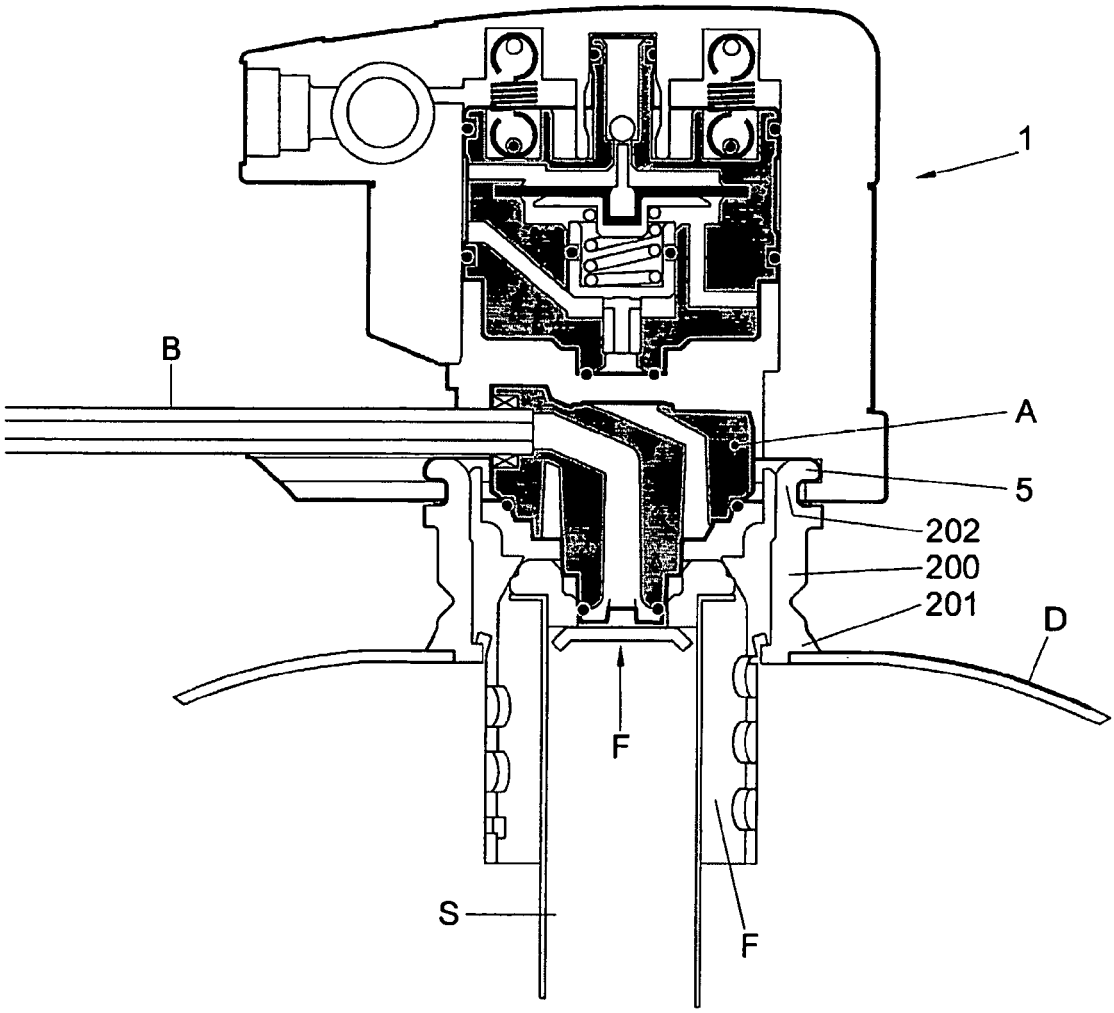
FIG. 8 shows a connecting device as shown in FIG. 7, fitted onto a container, with an alternative dispensing device.
Figure 9:
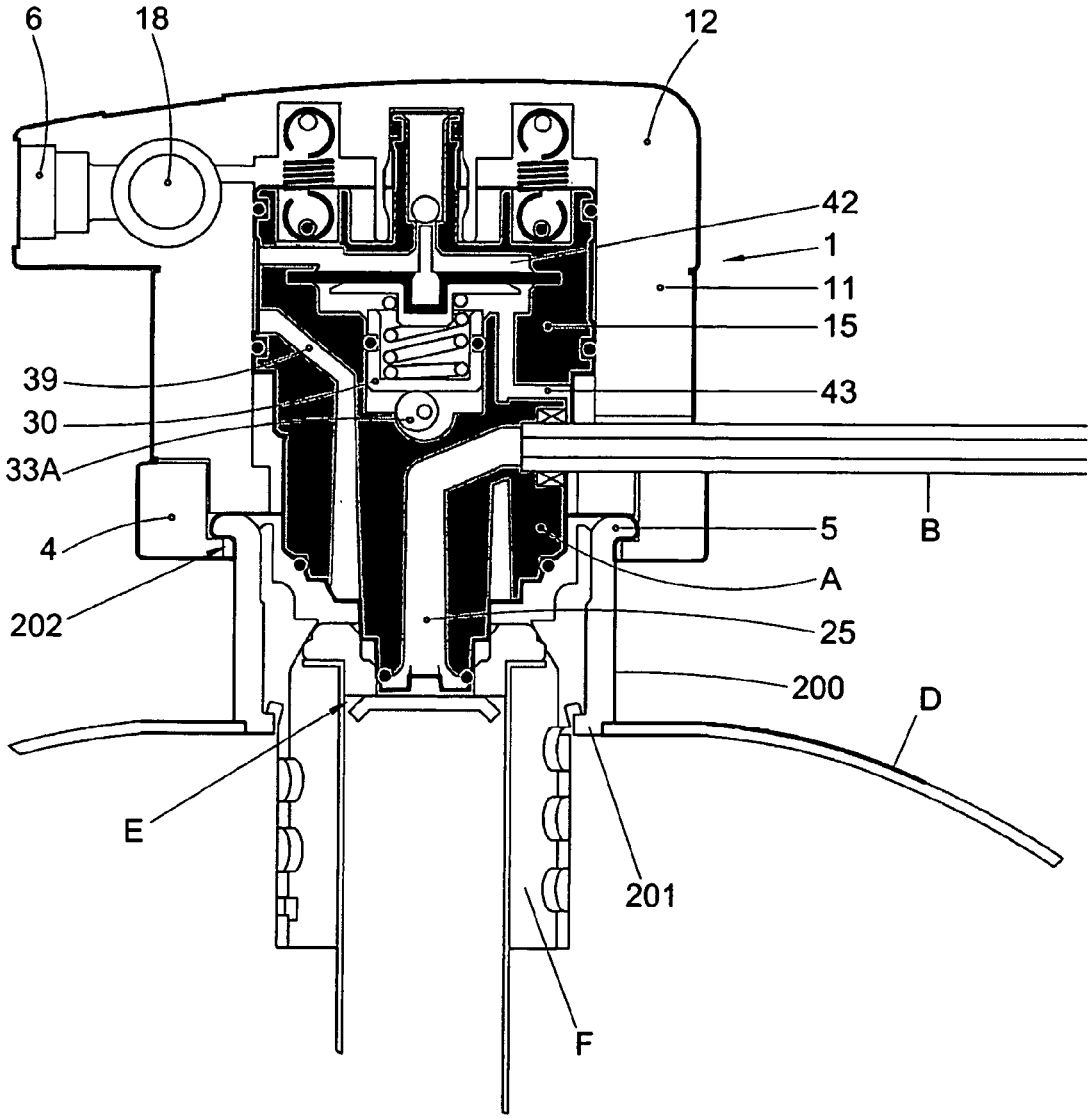
FIG. 9 shows a connecting device according to the invention, in a first alternative embodiment, fitted on a container.

FIG. 9 shows in sectional side elevation an alternative embodiment of a connecting device 1 according to the invention, in which a dispensing device A similar to that shown in FIG. 8 is designed integrally with the piston 15. This is represented schematically. In this embodiment, in FIG. 9 on the right, the deaeration channel 43 is shown, while on the left side the inclined channel 39 is represented, which, again along the longitudinal wall of the chamber 14, is in fluid communication with the upper channel 41 and the pressure chamber 42. In this embodiment, the inner piston 30 can be set with the aid of an eccentric 33A, for pre-setting the regulating pressure. In this embodiment, the connecting device 1 is secured on the collar 5 of the container D with the aid of damping means, as, for instance, to be further described with reference to FIGS. 10-14.

Figure 10:
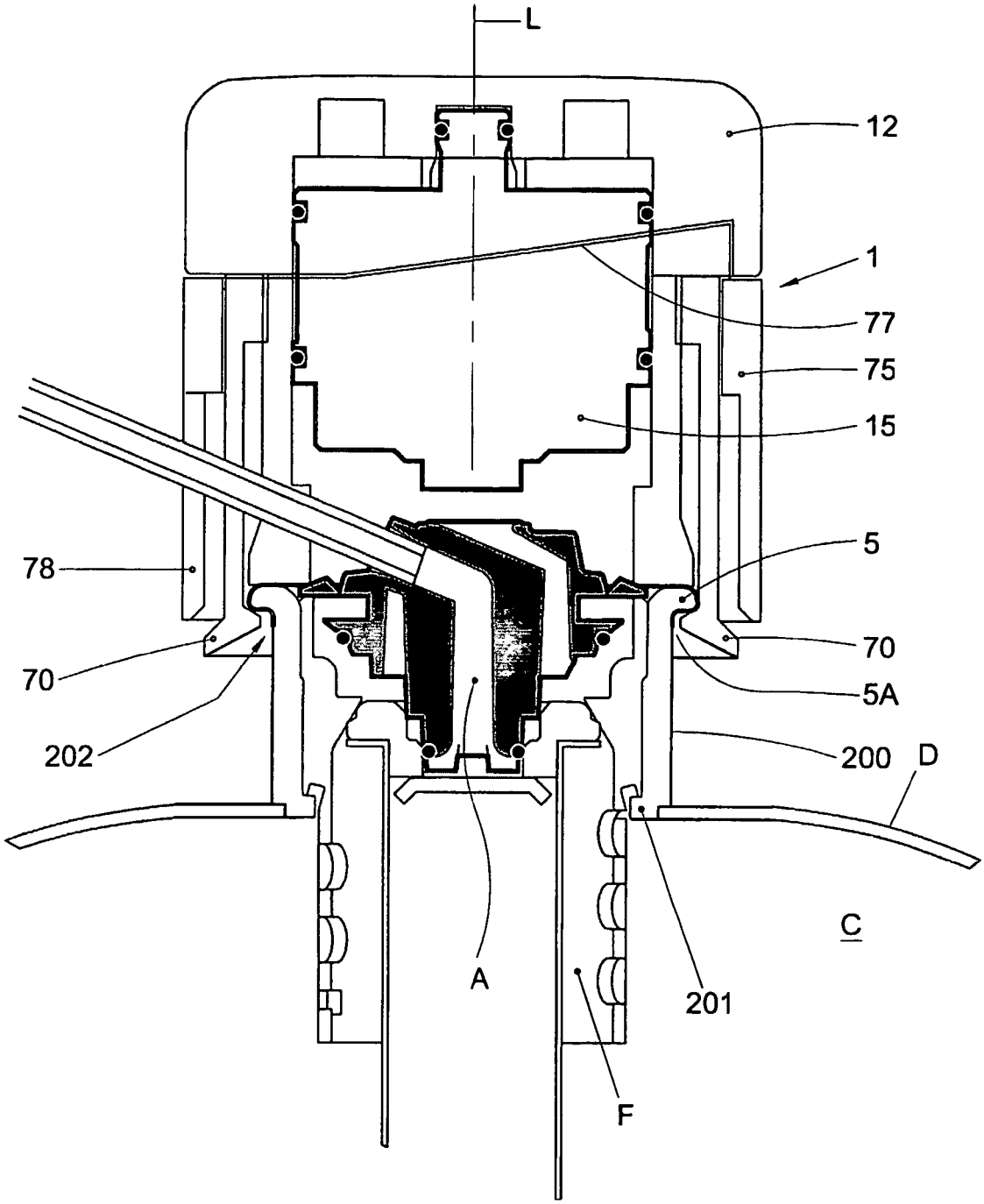
FIGS. 10,10A and 11 show a connecting device according to the invention in a second alternative embodiment.
Figure 10A:
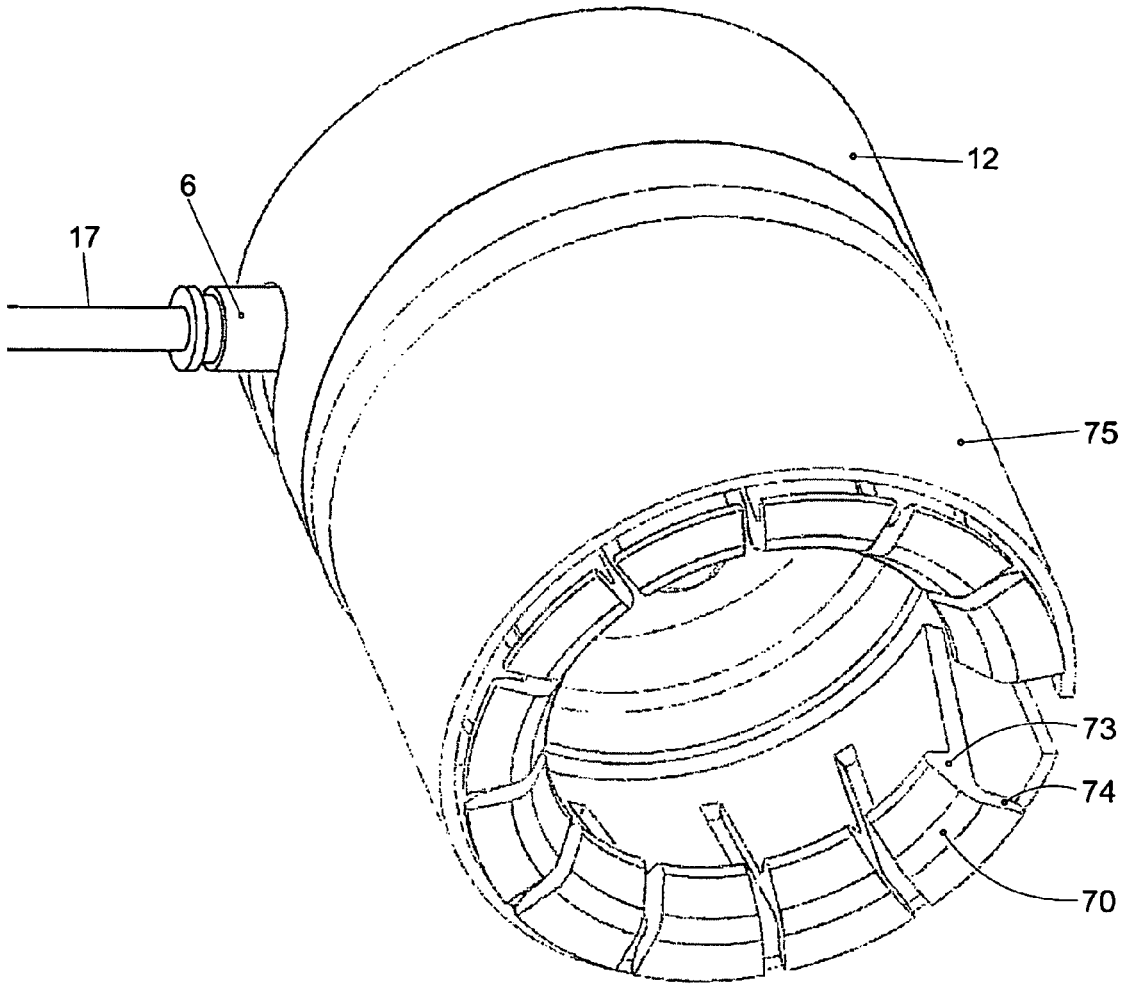
Figure 11:
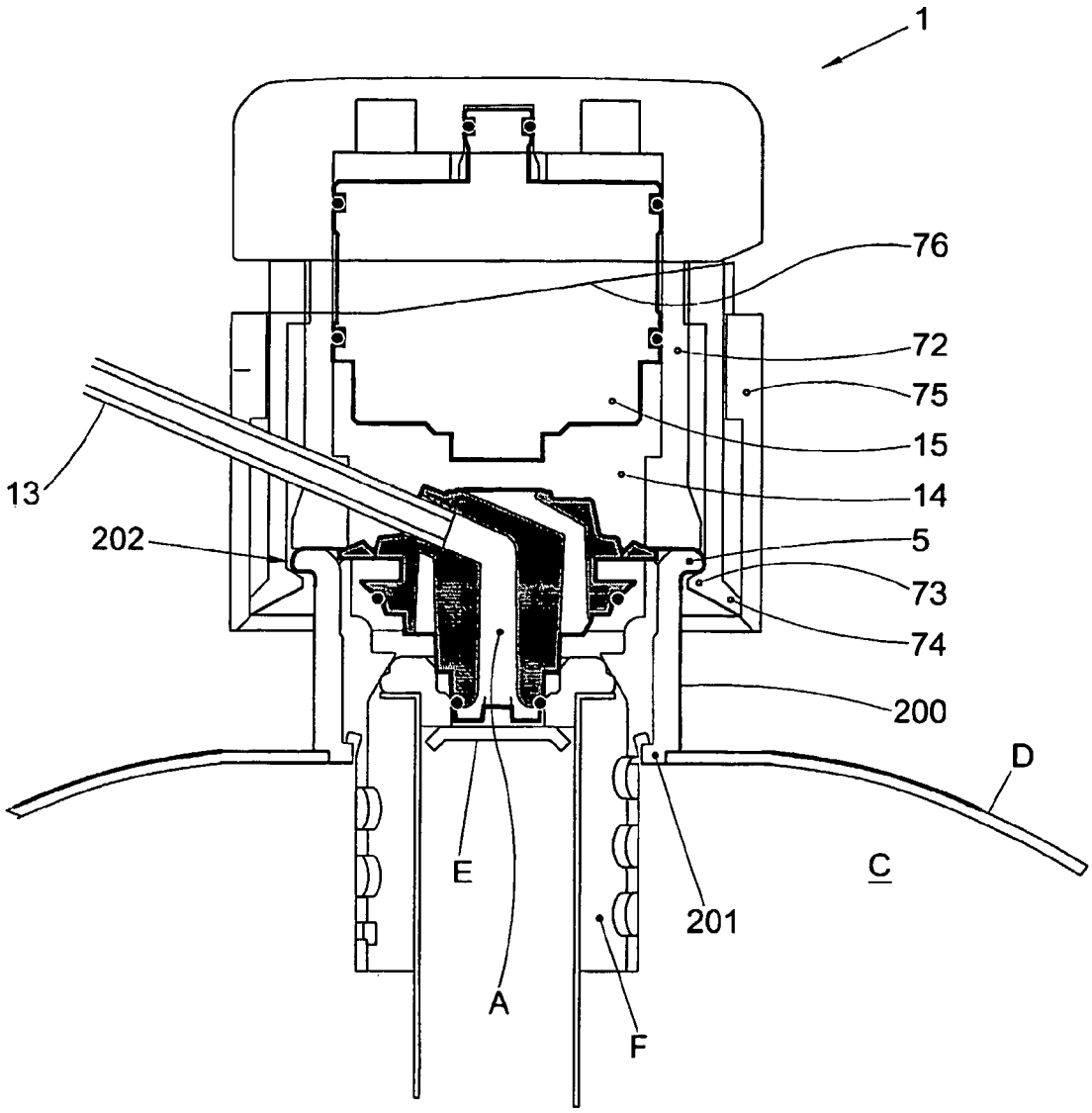

FIGS. 10 and 11 schematically show in sectional side elevation an alternative embodiment of a connecting device 1 according to the invention, which is chiefly distinguished from, for instance, that as shown in FIGS. 1-7, by the means through which the connecting device 1 is secured to the collar 5 of the container D. For simplicity, the piston 15 is only represented in contour. In this embodiment, the shoe 4 has been replaced with a series of arms 70, for instance as shown in FIG. 10A, in which a connecting device 1 according to FIGS. 10 and 11 is schematically shown in perspective bottom view. The arms 70 are designed as segments of a ring, which ring is fixedly connected with a cylindrical inner wall 72 which surrounds the chamber 14. The fingers 72, adjacent their lower end, on the inwardly facing side, are provided with hook-shaped cams 73, while these are provided on the outside with outwardly extending butting faces 74. On the outside, along the arms 70, an axially slidable sleeve 75 is provided, which, at the upper side, is provided with a sloping run-on face 76. The upper part 12 in this embodiment is rotatable about the longitudinal axis L, and on the side facing the sleeve 75 is provided with a sloping run-on face 77, complementary to the run-on face 76. In FIG. 10, the upper part 12 is shown in a first position, in which it fittingly abuts against the upper side of the sleeve 75. The lower end 78 of the sleeve is then situated slightly above the butting faces 74 of the arms 70. In this condition, the connecting device, by the arms 70 thereof, can be pressed over the collar 5, such that the cams 73 engage in the slot 5A under the collar 5. Thereupon the upper part 12 is rotated about the longitudinal axis 11 relative to the further connecting device 1, so that the run-on faces 76, 77 are moved along each other, and the sleeve 75 is consequently moved down axially in the direction of the container D. The lower longitudinal edge 78 of the sleeve 75 thereby moves on the outside along and against the butting faces 70, so that these are forced inwards and are locked against the neck, such that the cams 73 are fixed in the slot 5A. In this condition, the connecting device 1 is safely and fixedly connected with the container D, as shown in FIG. 11. This coupling can only be broken when the upper part 12 is rotated back to the first position. It is preferred that turning the upper part 12 back is possible only when the piston 15 has been moved back into the upper, first position shown in FIG. 10.

Figure 12:
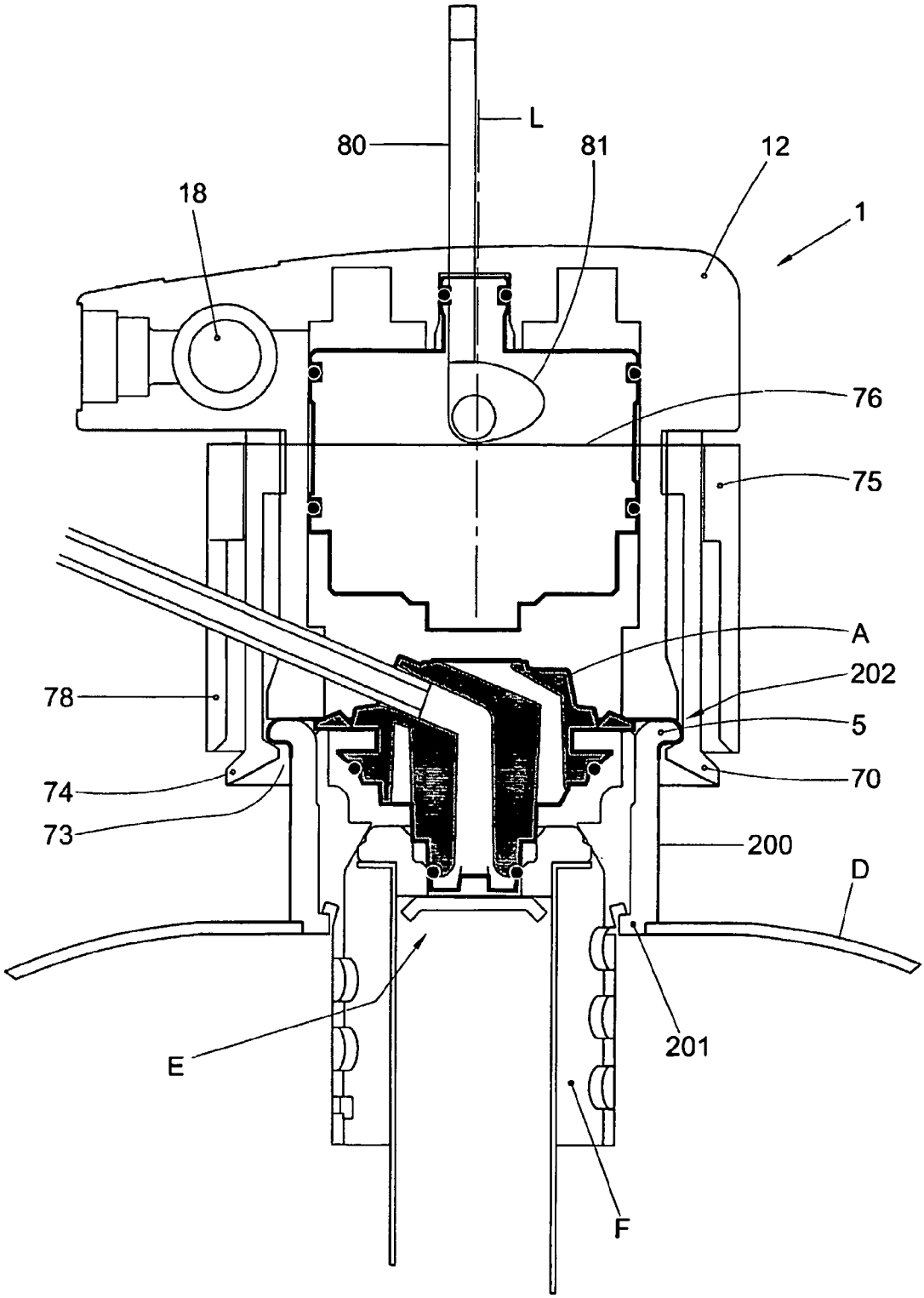
FIGS. 12 and 13 show a connecting device according to the invention, fitted on a container, according to a third alternative embodiment.
Figure 13:
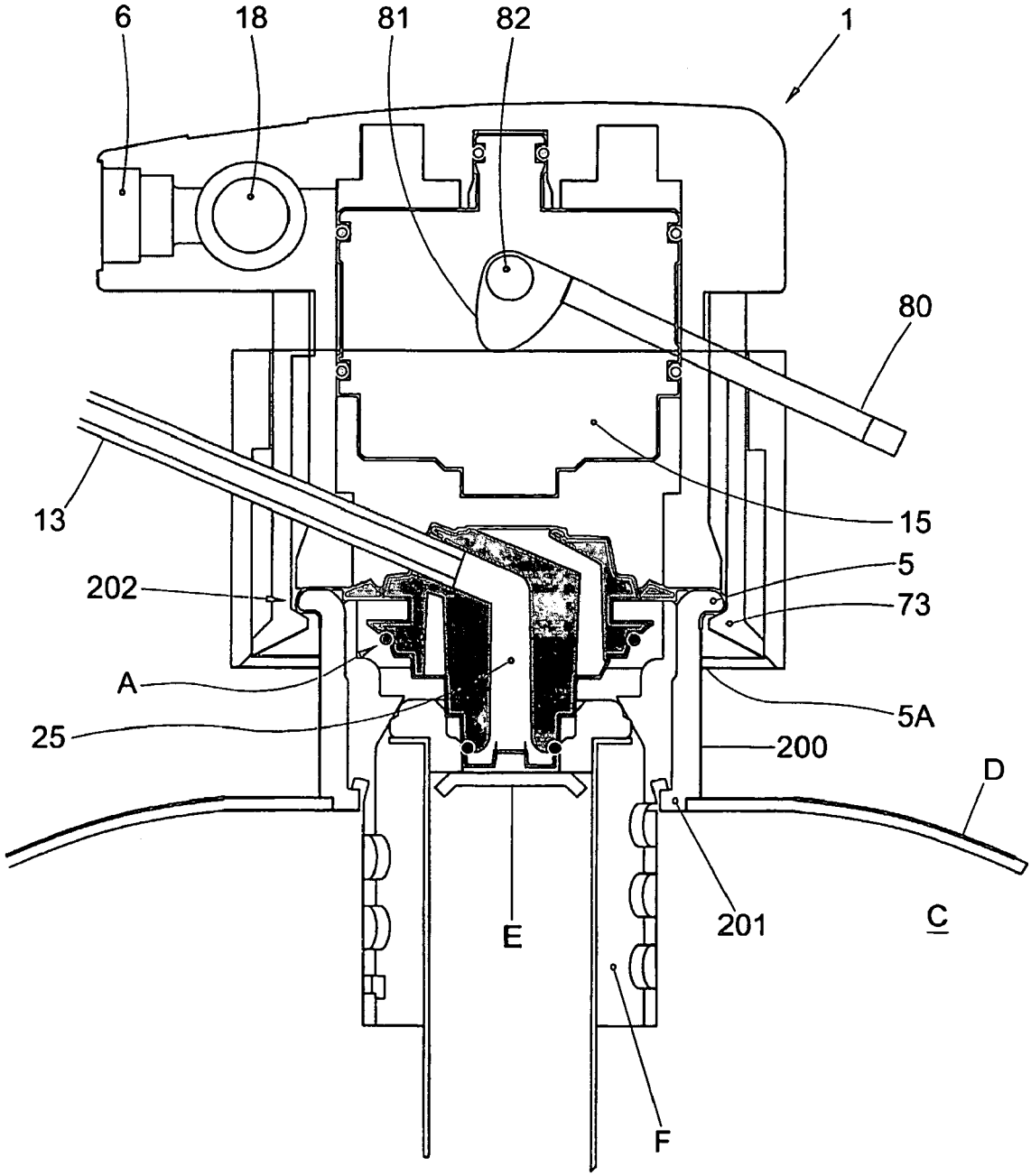

In FIGS. 12 and 13, again an embodiment of a connecting device 1 according to the invention is shown, similar to that as shown in, for instance, FIGS. 10 and 11, in forming an assembly according to the invention, coupled to a container D with interposition of a dispensing device A. In this embodiment, however, the sleeve 75 is moved along the arms 70 using a lever 80 with an eccentric 81. In FIG. 12 the lever 80, which is schematically represented, extends approximately parallel to the longitudinal axis L. In this condition, the connecting device 1, by the arms 70 thereof, can be pressed over the collar 5. Thereupon the lever 80 is pivoted about the axis 82 to the condition shown in FIG. 13, such that the sleeve 75 is moved down by the eccentric 81 for locking the arms 70, at least the cams 73 in the groove 5A. Release of the connecting device 1 can be effected by pivoting the lever 80 back into the condition shown in FIG. 12, whereupon the connecting device 1 can be pulled away in upward direction. It is then preferred, again, that pivotal movement of the lever 80 can occur only when the piston 15 is in the upper, first position shown in FIGS. 12 and 13.

Figure 14:
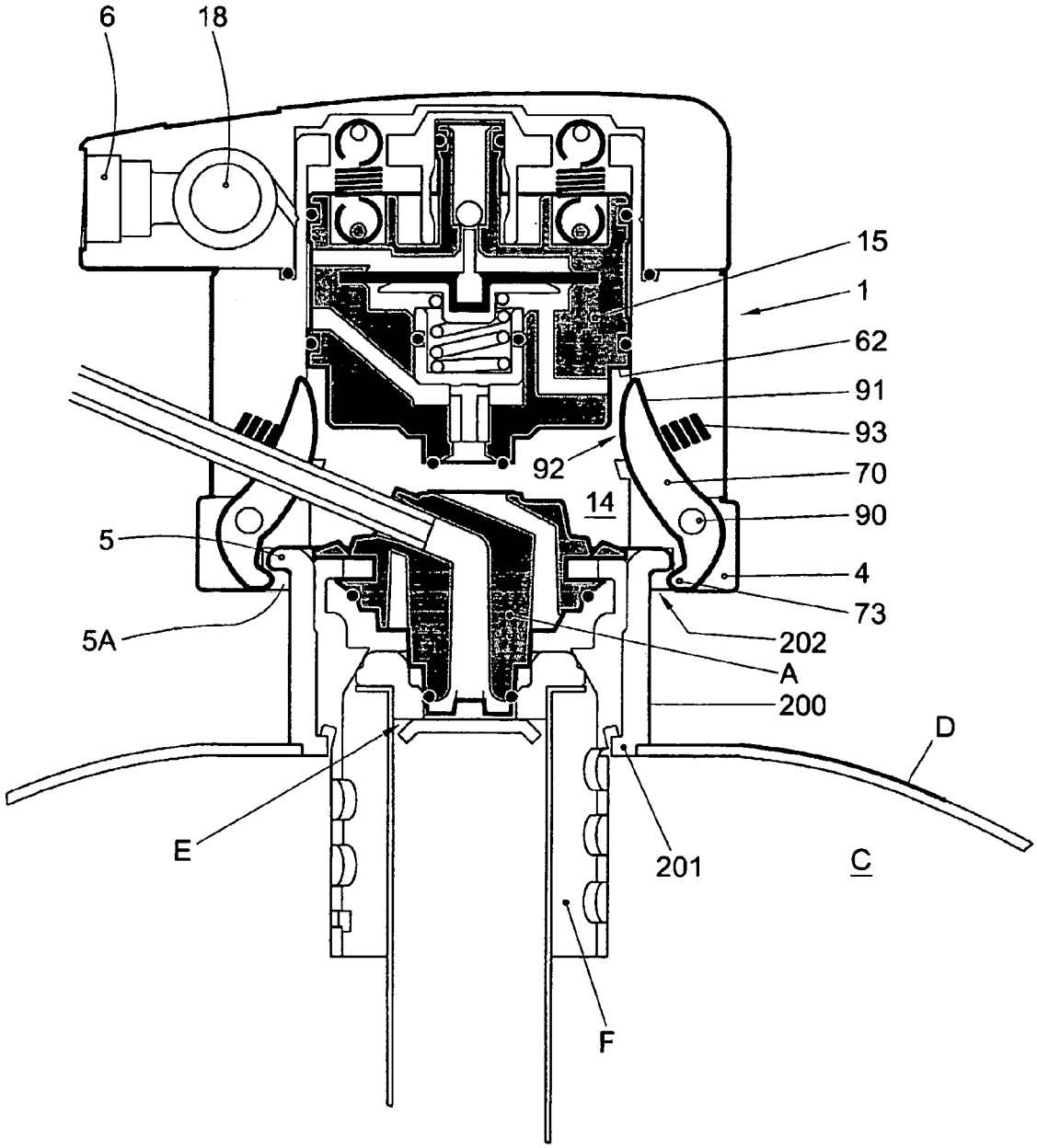
FIG. 14 shows a connecting device, fitted onto a container, in a fourth alternative embodiment.

In FIG. 14, again an assembly of a container D, a dispensing device A and a connecting device 1 are shown, with alternative coupling means provided. In this embodiment, in the shoe 4 arms 70 are provided, which are pivotable about pivot axes 90. Each arm 70 is provided, adjacent a lower end, with a cam 73 which can be fittingly received in the groove 5A of the neck of the container D under collar 5. On the side of the cam 73 remote from the pivot axis 90, each arm 70 is provided with an arm part 91 which has an inwardly facing curved surface 92 reaching into the chamber 14, under the piston 15. In this position, as shown in FIG. 14, the arms 70 are biased inwards by schematically represented springs 93. When the piston 15 is moved down axially in the manner described earlier, through supply of pressure medium, a longitudinal edge 62 of the piston 15 moves onto and then along the curved surface 92 of the arm 70, so that it is pressed outwards against the spring pressure of the spring 93. The arm 70 thereby pivots about the pivot axis 90, so that the cam 73 is forced into the groove 5A and is locked therein. The arms 70 are retained in that condition by the piston 15. Only when the piston 15 is moved back up to the first position can the arms 70 be released again and can the connecting device 1 be detached.

Figure 15:
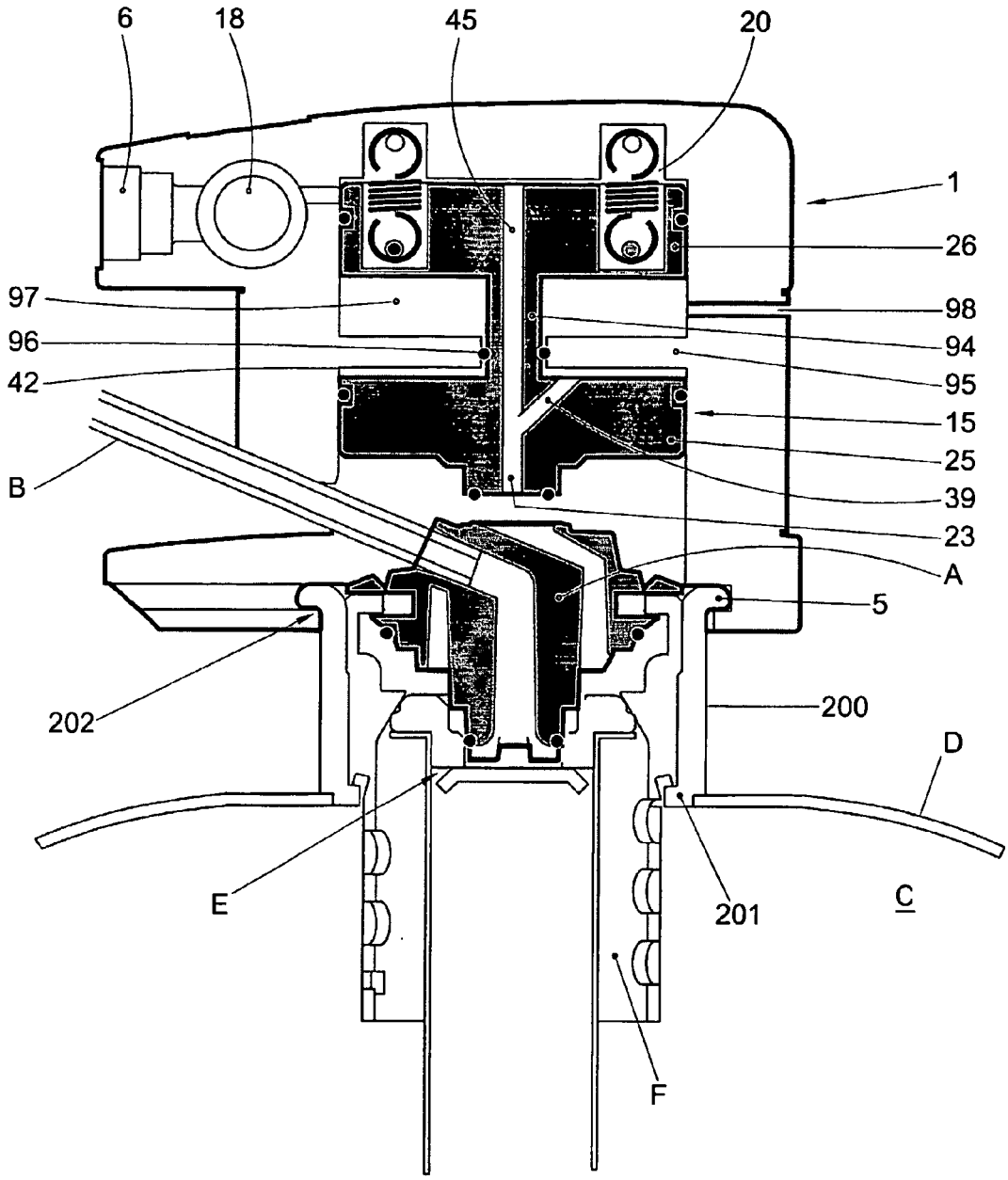
FIG. 15 shows a connecting device according to the invention, fitted on a container, in a fifth alternative embodiment.

FIG. 15 shows an assembly according to the invention with a further alternative embodiment of a connecting device 1 according to the invention, coupled to a container D. In this embodiment, a control pressure is used which is approximately equal to the desired regulating pressure. The piston 15 is here of double design. The piston 15 comprises a lower piston part 25 and an upper piston part 26, mutually connected through a piston rod 94 which extends through an opening in an intermediate wall 95, and is movable in the opening while being sealed through an O-ring 96. Between the intermediate wall 95 and the upper piston part 26, a chamber 97 is provided, in open communication with the surroundings through a bleed channel 98. A main channel 45 extends through the two piston parts 25, 26 and the piston rod 94, so that there is an open fluid communication between the chamber 20 above the upper piston part 26 and the passage opening 23, formed by the open lower end of the main channel 45. Formed between the lower piston part 25 and the intermediate wall 95 is a pressure chamber 42, which via an inclined channel 39 is in communication with the main channel 45. Upon supply of pressure medium under the regulating pressure, for instance reduced by a conventional reducing valve, regulating pressure is built up in both the chamber 20 and the pressure chamber 42, so that with relatively small-sections a double piston surface is obtained, sufficient to control the valve E of the container D to open.

Figure 16:
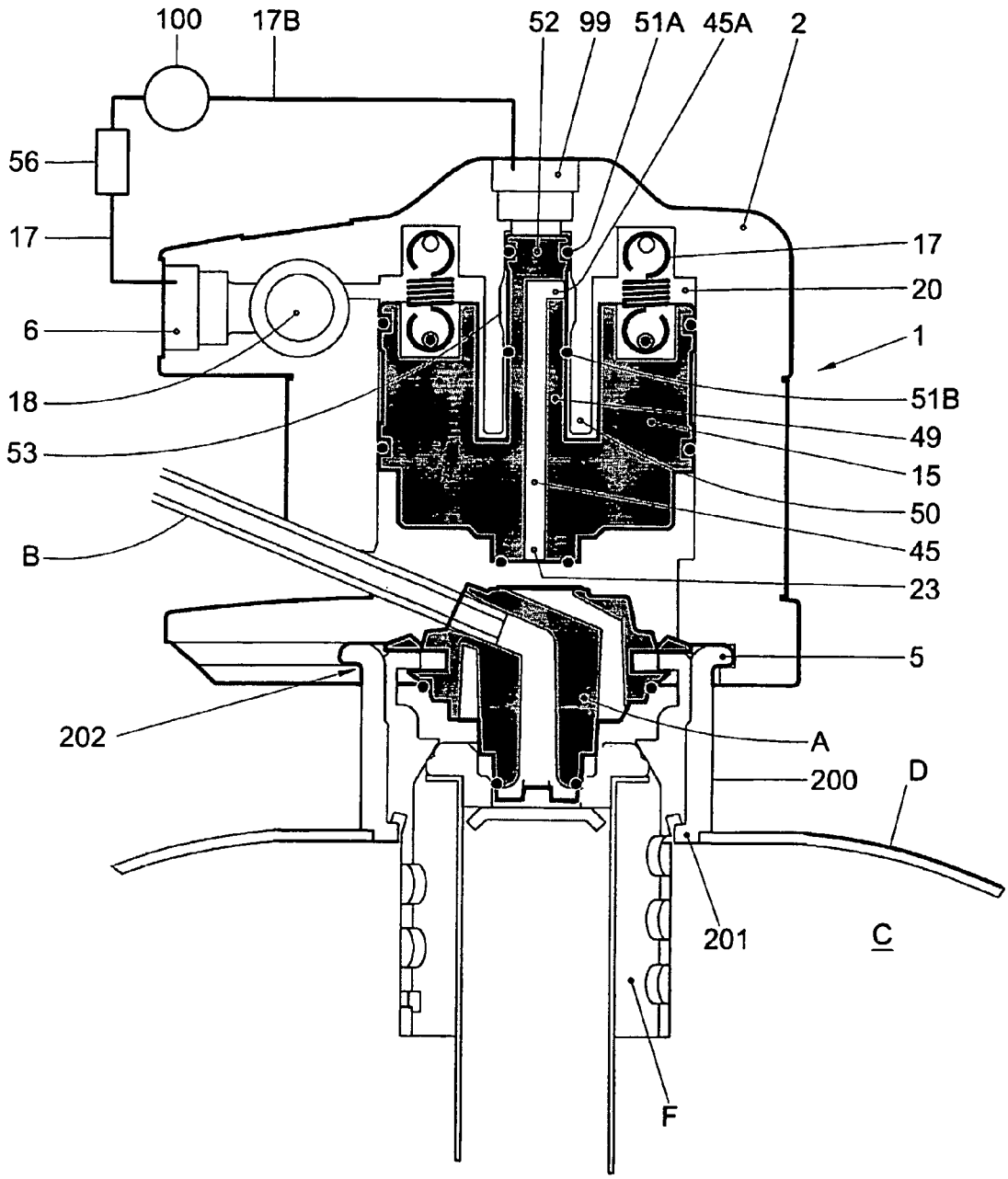
FIG. 16 shows a connecting device according to the invention, fitted on a container, in a sixth embodiment.

FIG. 16, further, shows an embodiment of an assembly according to the invention, provided with a container D having fitted thereon a connecting device 1, in a further alternative embodiment, again represented schematically. In this embodiment, use is made of first connecting means 6 for connection of a supply line 17 for supply of pressure medium under a relatively high control pressure, while adjacent the upper side of the connecting device second connecting means 99 are provided for connection of a supply line 17A which is connected via a reducing device 100 with a pressure source 56. Via the second supply line 17A, pressure medium with the regulating pressure is supplied via the second connecting means 99. In this embodiment, the piston 15, which is again suspended in the housing 2 via springs 17, is provided with a main channel 45 which extends axially through the middle of the piston and is open at the underside for forming the passage opening 23. At the upper side, the piston 15 is provided with a substantially cylindrical part 49, with a closed end wall 52. The main channel 45, via an approximately horizontal part 45A, is open to the outside of the cylindrical part 49, between an upper O-ring 51A and a lower O-ring 51B. The cylindrical part 49 extends in a likewise approximately cylindrical casing 50 which is provided with a widening 53, approximately similar to that shown in FIG. 4. In the first position shown in FIG. 16, the O-rings 51A, B are located respectively above and below the widening 53, while the main channel 45 terminates via the horizontal part 45A in said widening 53. The fluid communication between the second connecting means 99 and the passage opening 23 is thus closed off. When pressure medium is introduced via the first connecting means 6 into the chamber 20 above the piston 15, the piston is moved down, to a second position. In this second position, the valve E is open and the upper O-ring 51A is situated in the widening 53, so that a fluid communication is obtained between the second connecting means 99 and the passage opening 23 via the widening 53. Then pressure medium under regulating pressure is introduced into the container D and liquid such as beer can be displaced from the interior C of the container D via the line B. Such an embodiment has the advantage- that it is relatively simple in construction, notably because no internal pressure reducing means are provided.

Figure 17:
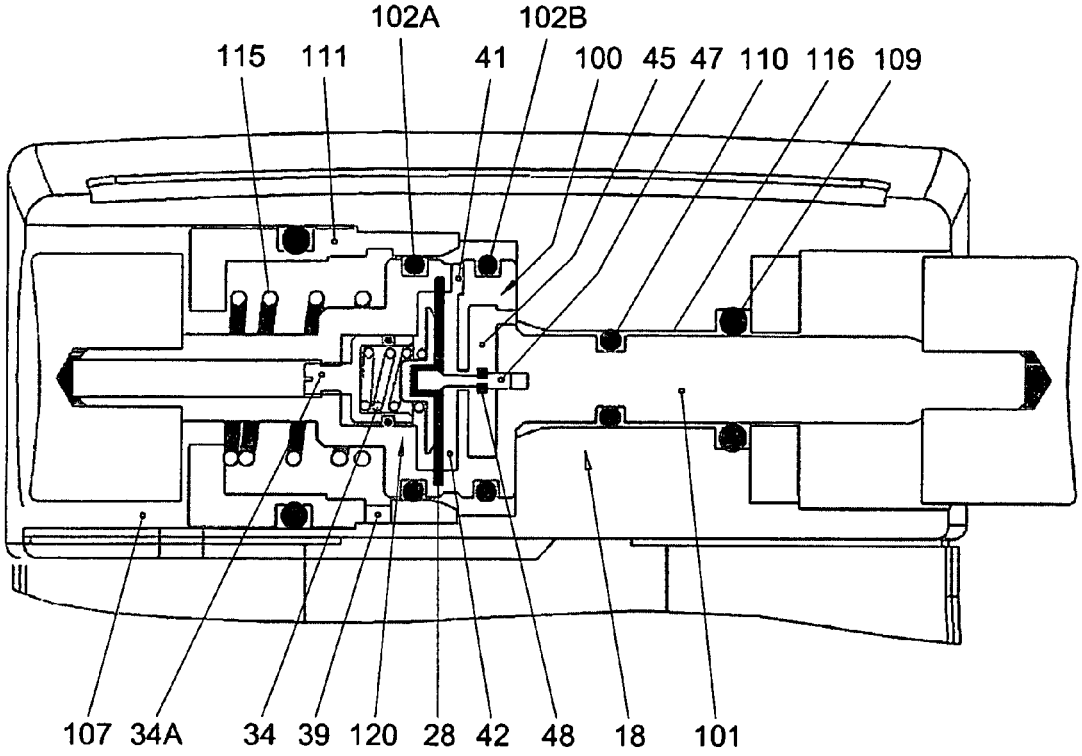
FIG. 17 shows in cross-sectional view an operating means with built-in pressure regulating mechanism.
Figure 18:
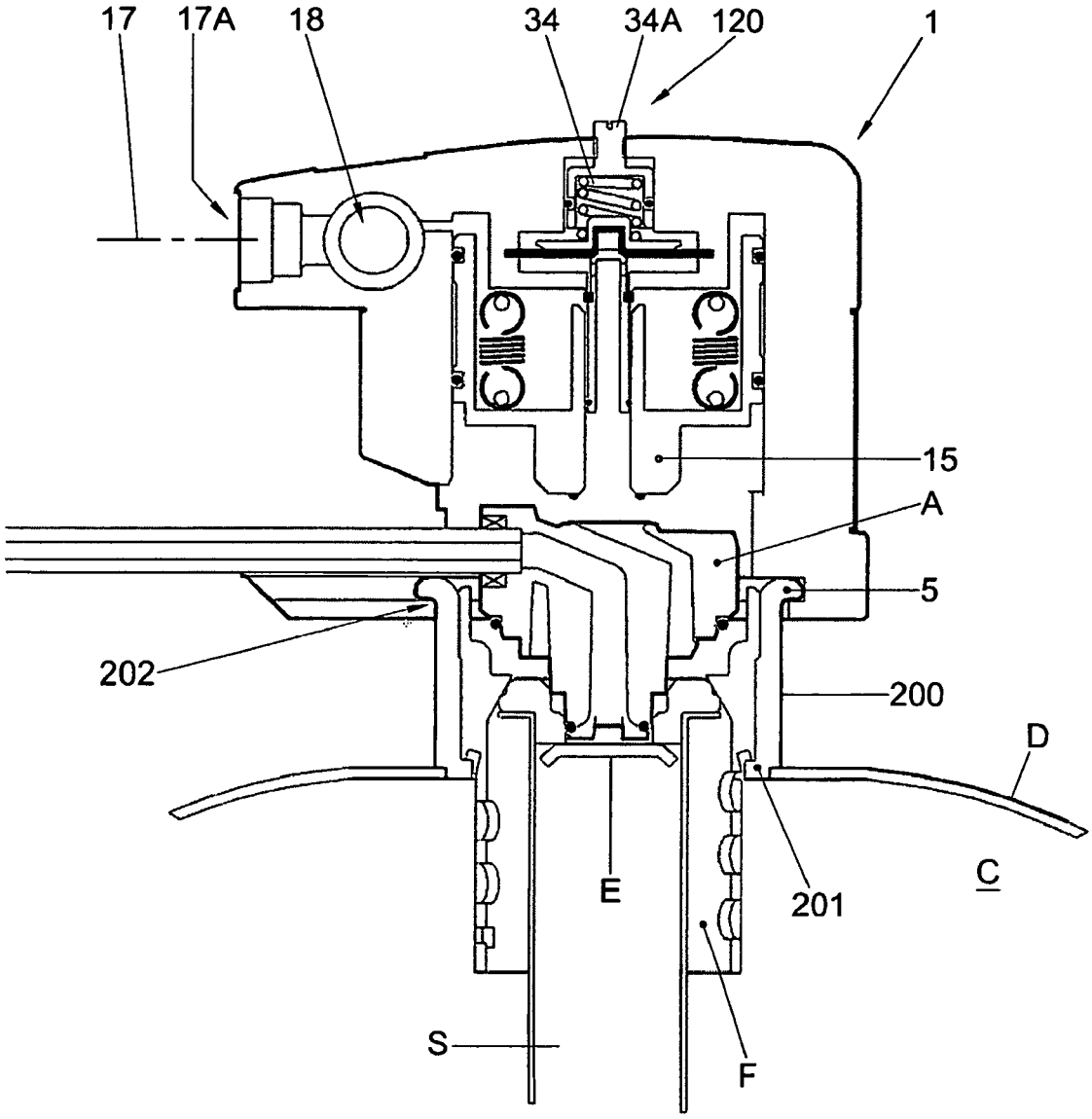
FIG. 18 shows a connecting device according to the invention with externally accessible pressure regulating valve.

FIGS. 17 and 18 show two alternative positions of pressure regulating means for a connecting device according to the present invention. In the embodiment shown in FIG. 17, the pressure regulating means 120 are included in the operating means 18, in a part comparable to the flange 100 as shown in FIG. 6. Again, a supply line (not shown) terminates between a second packing 109 and a third packing 110, in the bore 116, while in the flange 100 the pressure regulating device 120 is included, which is again movable in a sleeve 111, which has been screwed into the second knob chamber 107. Provided around the flange 100 in this embodiment are two first packings 102A, 102B, between which terminates an upper channel 41 which reaches into a pressure chamber 42. As regards the pressure regulating device 120, reference numerals have been used corresponding to those in, for instance, FIG. 3. A membrane 28 separates the pressure chamber from a chamber 44 with a spring 34 therein, with which in a manner described earlier an equilibrium pressure can be set. A plunger pin 47 with sealing means 48 is movable through the membrane. In the condition shown in FIG. 17 the operating device 18 is closed and the chamber ventilates via the channel 41 to the surroundings. If the shaft 101 is moved from this position to the left in FIG. 17, the two first packings 102A, 102B are moved into the sleeve 111, such that the channel 41 terminates in an annular channel 39 between them, which annular channel 39 is in communication with a channel 20A (not shown) which leads to the chamber 20 of the connecting device 1. As a result, gas can flow through the bore 116 along the third packing 110 and the main channel 45, along the rod 47 and the sealing means 48 into the pressure chamber 42 and thence via the channel 41 and the annular channel 39 to the chamber 20. Again, an equilibrium is created between the gas pressure on the flange 100 and the spring pressure of the spring 115. It can again be set by screwing-in the sleeve 111 to a further or less far extent. The regulating pressure of the pressure regulating means 120 are again settable with the aid of the spring 34 and an adjusting screw 34A.

In FIG. 18 a sectional elevation of a connecting device according to the invention is shown, in which pressure regulating means 120 as described with reference to, for instance, FIG. 17 are included in the top of the connecting device 1, between the piston 15 and the operating means 18. An adjusting screw 34A is again accessible from outside for setting the regulating pressure with the aid of the spring 34.

Figure 19:
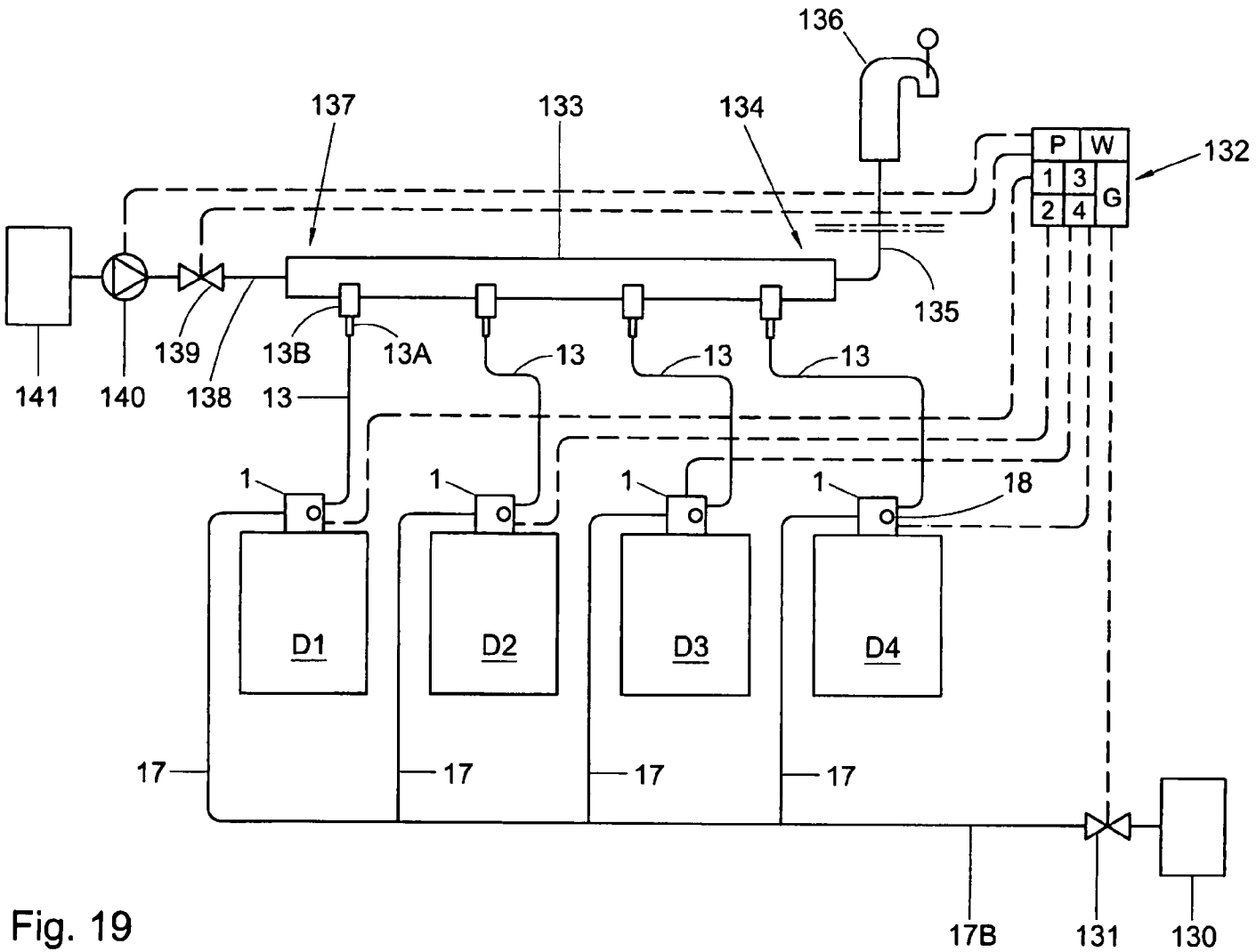
FIG. 19 schematically shows an alternative method of connecting containers with pressure regulating devices according to the present invention.

FIG. 19 schematically shows an alternative manner of connecting containers using connecting devices according to the invention. In this embodiment, a series of containers, for instance four containers D1-D4, are arranged next to each other, each provided with a connecting device 1 according to the invention, which are connected via connecting lines 17 with a pressure source 130. In the central connecting line 17B an electrical gas valve 131 is included, operable with the aid of a control panel 132 as will be further elucidated.

Preferably used are connecting devices 1 with dispensing devices A as described, for instance, with reference to FIG. 7, which connecting device A together with a connecting line B is disposable and can be taken away along with the respective container D1-D4. At the free end of the line B, a rapid coupling element 13A is fitted which can be simply coupled with a counter rapid coupling member 13B fitted on a central line 133. In this way, the four containers D1-D4 can be coupled to the central line 133. Connected to a first end 134 of the central line 133 is a tapping line 135 which is coupled with a known tapping device 136. Connected to the central line 133 at the opposite second end 137 is a rinsing line 138 which via an electronic washout valve 139 and a pump 140 is connected with a source for rinsing agent, for instance a water supply system. If the source for rinsing agent 141 offers sufficient pressure, the pump 140 can naturally be omitted. In the connecting devices 1 operating means 18 are provided which are remotely operable, preferably electrically from the control panel 132. Moreover, the valves 131 and 139 and the pump 140 are coupled with the control panel 132. With such an arrangement, the containers D1-D4 can be disposed, for instance, in a separate space such as a cold store, cellar or the like and be simply coupled with the aid of the coupling means 13A, 13B. Thereupon, from the control panel 132, preferably arranged adjacent the tap 136, it can be controlled which container D is to be broached by controlling the respective operating means 18 of the connecting device 1 to open or close. With the aid of knob G the gas valve 131 can be opened for pressurizing the respective container. When a container is to be replaced, the dispensing device 1 is detached from the respective container D1-D4 and the container with the dispensing line B is uncoupled from the central line 133, whereafter it can be replaced with a new container. When cleaning of the central line 133 and the tap 136 is required, all dispensing devices 1 are closed, whereafter the washout valve 139 is opened with the valve W and the pump 140 is controlled by the knob P, so that rinsing liquid such as water with cleaning agent is flushed through the central line 133, the tapping line 135 and the tapping device 136. Thereupon the washout valve 139 can be closed again and the tapping device can be used again. Optionally, the counter rapid coupling means 13B can also be provided with remotely operable valves, thereby enabling rinsing without requiring the tapping lines B to be present. Naturally, this can also be done through the use of counter rapid coupling means 13B which are self-closing when no tapping line B is connected.

In the exemplary embodiments shown, in the pressure regulating means 120 in each case a spring 34 with associated setting means 34A is provided. The operation thereof is substantially temperature-independent. In an advantageous embodiment, the spring can be replaced with, or be supported by, a means capable of exerting pressure on the membrane in a temperature-dependent manner. To that end, for instance, known bellows, spheres or the like, filled with wax or similar substances expanding upon heating, can be included in the pressure regulating device, instead of, or in addition to, a spring 34. Another option is to use resilient means manufactured from memory material, such that the shape and/or length thereof inherently adjust to the temperature. These temperature-dependent regulating means are to be selected such that when the container, at least the fluid present therein and to be dispensed, heats up, the pressure exerted on the membrane by those means and/or the spring increases. Naturally, also electronic or electromagnetic or like known pressure regulating means can be used within a dispensing device according to the present invention. Fitting in particular the temperature-dependent pressure regulating means as described before, on or immediately adjacent to the container, in particular within the dispensing device, offers the advantage that it is substantially completely dependent on the temperature of the container, at least the fluid present therein, and not on the ambient temperature. As a result, a particularly good regulation is possible.

For the embodiments shown, it holds that the connecting device 1 can be placed particularly easily and is orientation-direction independent to a high degree. As long as the connecting device of the piston, at least the valve operating mechanism, is approximately equal to the longitudinal axis of the neck 200, the first and second coupling means can be coupled, regardless of the direction in which the connection 6 for the gas supply and/or the line B point.

It will be clear that a handle-tapping head known per se can also be designed with first coupling means according to the invention. As the flange 5 defines the greatest diameter of the neck 200, and between the flange 5 and the container relatively much space is present, the coupling means of the connecting device can be made of robust design, so that a great freedom in the choice of material for these first coupling means has been obtained. Moreover, such a neck can be produced relatively inexpensively, for instance by forging or upsetting, at least substantially not by a material removing operation.

In most variants shown, the neck 200 under the flange 5 has been given a straight and smooth finish. However, in these embodiments the necks can also be made of different design, for instance as shown in FIG. 8. Also, optionally, further flanges, ridges and the like may be provided with a diameter greater than that of the flange 5, but preferably this is not the case, for reasons mentioned earlier, such as manufacture, economy, cleaning, connection to existing installations, free space and the like.

The invention is not in any way limited to the exemplary embodiments represented in the description and the drawing. Within the framework of the invention outlined by the claims, many variations are possible, including any combination of parts of the exemplary embodiments given in the drawing and the description.

For instance, in each of the above-shown exemplary embodiments of a connecting device according to the invention, the piston can be integrated with the dispensing device, as shown, for instance, in FIG. 9, while these may also be provided separately. Further, a same connecting device according to the invention can also be adapted for use with other containers, for instance containers with a different type of valve. Such valves are sufficiently known from practice and adaptation thereto of a connecting device according to the invention will be immediately clear to one skilled in the art. In the exemplary embodiments shown, in each case a container is shown in which pressure-medium is brought directly into the interior of the container, in contact with the liquid to be dispensed. It will be clear, however, that a same connecting device is also applicable with containers in which an inner bag is received, so-called bag-in-box or bag-in-container systems. As pressure medium, any suitable fluid can be used, both liquid and gas. Operating means can be arranged in other ways, for instance a conventional gas cock. Other types of coupling means can be used for coupling a connecting device to a container within an assembly according to the invention, for instance screw means, bayonet-shaped means and the like, as long as they engage the neck 200 of the container, in particular the flange 5 thereof, thereby locking the tapping rod F. Also, in the connecting device, the reducing means can be made of different design, for instance a conventional reducing valve.

These and many comparable variations are understood to fall within the framework of the invention as outlined by the claims.

The invention claimed is:

1. An assembly of a container and a connecting device for connecting the container to a pressure source for a pressure medium, wherein the container is provided with a tapping rod having therein at least one valve for releasing an input and/or output opening of the container, wherein the connecting device is provided with a housing with first coupling means and the container is provided with a casing with a cylindrical neck having a first end and an opposite second end, said neck is secured by the first end on the casing and adjacent the opposite second end is provided with an outwardly extending flange having an underside and a maximum diameter, which defines second coupling means for cooperation with the first coupling means, wherein the tapping rod is secured in the neck and wherein the neck, between the neck flange and the first end of the neck, is smoothly finished on the outside of the neck so as to be readily cleanable, the neck having a diameter at least adjacent the outwardly extending flange that is smaller than the maximum diameter of the outwardly extending flange, the assembly of the container and the connecting device being such that when the connecting device and the container are coupled by the first coupling means and the second coupling means, the first coupling means are at least supported against the underside of the flange proximal to the second end of the neck, and the tapping rod is locked in the neck by at least the connecting device, and wherein means are provided for pressing open a valve of the tapping rod, said means for pressing open comprising a piston which is controllable to a first, second and third position, wherein in the first and third position input means for a pressure medium are closed off and in the second position the input means are open, and wherein the third position is situated on a side of the second position remote from the first position.

2. An assembly according to claim 1, wherein the first coupling means are arranged to be slid over the flange in a direction approximately at right angles to the longitudinal direction of the neck, while during use the connecting device, through the first coupling means, is pulled against the underside of the flange.

3. An assembly according to claim 1, wherein the first and/or second coupling means are operable with aid of the pressure medium coming from the pressure source, for clamping the first coupling means in or onto the second coupling means.

4. An assembly according to claim 1, wherein a dispensing device is provided for enclosure between said at least one valve for releasing an input and/or output opening of the container and the connecting device, wherein a dispensing tube is attached to said dispensing device.

5. An assembly according to claim 1, wherein a dispensing device is provided between the connecting device and the tapping rod, the dispensing device comprising at least part of a beverage dispensing line.

6. An assembly according to claim 5, wherein the dispensing device is detachable from both the tapping rod and the connecting device.

7. An assembly of a container and a connecting device for connecting the container to a pressure source, wherein the container is provided with a tapping rod having therein at least one valve for releasing an input and/or output opening of the container, wherein the connecting device is provided with a housing with first coupling means and the container is provided with a casing with a cylindrical neck, said neck is secured by a first end on the casing and adjacent an opposite second end is provided with an outwardly extending flange, which defines second coupling means for cooperation with the first coupling means, wherein the tapping rod is secured in the neck and wherein the neck, between the flange and the first end, is substantially smoothly finished on the outside, and has at least substantially a diameter that is smaller than a maximum diameter of the flange, the assembly being such that in coupled condition of the connecting device and the container the first coupling means are at least supported against an underside of the flange proximal to the second end of the neck, and the tapping rod is locked in the neck by at least the connecting device; and further wherein the first coupling means comprise a foot having a substantially horseshoe-shaped recess, in which a slot is provided, open towards the recess, in which the flange is at least partly receivable, wherein the first coupling means are arranged to be slid over the flange in a direction approximately at right angles to the longitudinal direction of the neck, while during use the connecting device, through the first coupling means, is pulled against the underside of the flange and wherein means are provided for pressing open a valve of the tapping rod, said means for pressing open comprising a piston which is controllable to a first, second and third position, wherein in the first and third position input means for a pressure medium are closed off and in the second position the input means are open, and wherein the third position is situated on a side of the second position remote from the first position.

8. An assembly of a container and a connecting device for connecting the container to a pressure source, wherein the container is provided with a tapping rod having therein at least one valve for releasing an input and/or output opening of the container, wherein the connecting device is provided with a housing with first coupling means and the container is provided with a casing with a cylindrical neck, said neck is secured by a first end on the casing and adjacent an opposite second end is provided with an outwardly extending flange, which defines second coupling means for cooperation with the first coupling means, wherein the tapping rod is secured in the neck and wherein the neck has at least substantially a diameter that is smaller than a maximum diameter of the flange, the assembly being such that in coupled condition of the connecting device and the container the first coupling means are at least supported against an underside of the flange proximal to the second end of the neck, and the tapping rod is locked in the neck by at least the connecting device; and further wherein the first coupling means comprise a number of arms provided with hook-shaped elements for engagement under the flange and wherein means are provided for pressing open a valve of the tapping rod, said means for pressing open comprising a piston which is controllable to a first, second and third position, wherein in the first and third position input means for a pressure medium are closed off and in the second position the input means are open, and wherein the third position is situated on a side of the second position remote from the first position.

9. An assembly according to claim 8, wherein means are provided for securing the arms in a position coupled with the second coupling means, such that the first coupling means can only be separated from the second coupling means after said means for securing the arms have been actively released.

10. An assembly of a container and a connecting device for connecting the container to a pressure source, wherein the container is provided with a tapping rod having therein at least one valve for releasing an input and/or output opening of the container, wherein the connecting device is provided with a housing with first coupling means and the container is provided with a casing with a cylindrical neck, said neck is secured by a first end on the casing and adjacent the opposite second end is provided with an outwardly extending flange, which defines second coupling means for cooperation with the first coupling means, wherein the tapping rod is secured in the neck and wherein the neck on the outside, between the flange and the first end, is substantially smoothly finished, the assembly being such that in coupled condition of the connecting device and the container the first coupling means are at least supported against an underside of the flange proximal to the second end of the neck, and the tapping rod is locked in the neck by at least the connecting device; and further wherein in the housing an operating piston is provided, and between the housing and the operating piston a piston chamber is included, provided with connecting means for a supply line from the pressure source, the operating piston being provided with engaging means for cooperation with a valve of the container, for movement thereof between a first, closed position and a second, opened position, and input means are provided for introducing, with the valve in the second position, a pressure fluid from the pressure source along the at least one valve into the container, the assembly being such that during use said pressure fluid is introduced from the pressure source under a control pressure into the piston chamber, for operating the operating piston between a first position and a second position, while the input means are arranged for bringing the pressure fluid into the container under a regulating pressure, wherein a connection between the piston chamber and the container is provided through the piston.

11. An assembly according to claim 10, wherein the input means comprise pressure regulating means for reducing the control pressure to the regulating pressure, said regulating means being at least partly provided in the piston.

12. An assembly according to claim 10, wherein in the connecting device at least one channel is provided for forming a fluid communication between the piston chamber and the interior of the container, in coupled condition of the connecting device and container, the input means being at least partly included in said channel, while the fluid communication between the piston chamber and the interior of the container has been effected, or can be effected, exclusively with the operating piston and the valve in the second position.

13. An assembly according to claim 12, wherein in the channel a pressure regulating device is provided.

14. An assembly according to claim 10, wherein in the connecting device means is provided for releasing a fluid communication between the piston chamber and the pressure source.

15. An assembly according to claim 10, wherein the first and second coupling means can be coupled while the operating piston is in or near the first position.

16. An assembly according to claim 10, wherein a dispensing device is provided between the connecting device and the tapping rod, the dispensing device comprising at least part of a beverage dispensing line.

17. An assembly of a container and a connecting device for connecting the container to a pressure source, wherein the container is provided with a tapping rod having therein at least one valve for releasing an input and/or output opening of the container, wherein the connecting device is provided with a housing with first coupling means and the container is provided with a casing with a cylindrical neck, said neck is secured by a first end on the casing and adjacent the opposite second end is provided with an outwardly extending flange, which defines second coupling means for cooperation with the first coupling means, wherein the tapping rod is secured in the neck and wherein the neck, between the flange and the first end, is substantially smoothly finished on the outside, and has at least substantially a diameter that is smaller than a maximum diameter of the flange, the assembly being such that in coupled condition of the connecting device and the container the first coupling means are at least supported against an underside of the flange proximal to the second end of the neck, and the tapping rod is locked in the neck by at least the connecting device; and further wherein in the housing an operating piston is provided, and between the housing and the operating piston a piston chamber is included, provided with connecting means for a supply line from the pressure source, the operating piston being provided with engaging means for cooperation with a valve of the container, for movement thereof between a first, closed position and a second, opened position, and input means are provided for introducing, with the valve in the second position, a pressure fluid from the pressure source along the at least one valve into the container, the assembly being such that during use said pressure fluid is introduced from the pressure source under a control pressure into the piston chamber, for operating the operating piston between a first position and a second position, while the input means are arranged for bringing the pressure fluid into the container under a regulating pressure, wherein the piston is controllable from the second position to a third position, wherein the input means are closed off, the third position being situated on a side of the second position remote from the first position.

18. A connecting device for connecting a pressure source for a pressure medium to a container, the connecting device provided with means for pressing at least one valve of the container open, wherein coupling means are provided for coupling of the connecting device onto a flange on a neck of the container, wherein said means for pressing open the at least one valve of the container are arranged to be driven by said pressure medium, and wherein the connecting device is arranged for regulating a supply of the pressure medium to said container, during use after opening by the pressure medium of the at least one valve of the container, and wherein said means for pressing open the valve comprise a piston which is controllable to a first, second and third position, wherein in the first and third position input means are closed off and in the second position the input means are open, and wherein the third position is situated on a side of the second position remote from the first position.

19. A connecting device according to claim 18, said pressure medium supply having a pressure, wherein closing means are provided for closing off the pressure medium supply when the pressure falls below a minimum pressure.

20. A connecting device according to claim 18, wherein a dispensing device is provided for enclosure between said at least one valve for releasing an input and/or output opening of the container and the connecting device, wherein a dispensing tube is attached to said dispensing device.

21. An assembly according to claim 18, wherein a dispensing device is provided between the connecting device and the tapping rod, the dispensing device comprising at least part of a beverage dispensing line.

22. A connecting device for connecting a pressure source for a pressure medium to a container, the connecting device being provided with means for pressing at least one valve of the container open, wherein coupling means are provided for coupling of the connecting device onto a flange on a neck of the container, and further wherein the connecting device comprises coupling means for coupling thereof to the container, wherein further a housing is provided having therein a movable operating piston, wherein between the operating piston and the housing a piston chamber is formed in which a connecting channel terminates, wherein the housing, on a side of the operating piston remote from the piston chamber, is provided with an opening, and the operating piston is operable, by introducing the pressure medium into the piston chamber, between a first position wherein a volume of the piston chamber is relatively small and a second position wherein said volume is relatively large and the operating piston has been moved relative to the first position in a direction of said opening, and wherein said means for pressing open the valve comprise a piston which is controllable to a first, second and third position, wherein in the first and third position input means are closed off and in the second position the input means are open, and wherein the third position is situated on a side of the second position remote from the first position.

23. A connecting device according to claim 22, wherein a dispensing device is provided for enclosure between said at least one valve for releasing an input and/or output opening of the container and the connecting device, wherein a dispensing tube is attached to said dispensing device.

24. An assembly according to claim 22, wherein a dispensing device is provided between the connecting device and the tapping rod, the dispensing device comprising at least part of a beverage dispensing line.

25. A method for connecting a beer container to a pressure source and introducing a pressure medium into the container for displacing beer therefrom utilizing a tapping rod, wherein a connecting device is coupled with the container, adjacent a valve of the container, and the pressure source for the pressure medium has been or is coupled with the connecting device, whereupon the connecting device is energized, such that pressure medium under pressure flows into the connecting device, wherein the connecting device is secured on a neck of the container over the tapping rod in the container, such that the tapping rod is locked in the neck by the connecting device, wherein a piston is energized for controlling the valve of the container to open, whereupon the pressure medium is led into the container, from the pressure source, and wherein the pressure of the pressure medium in the connecting device is regulated before the pressure medium is introduced into the container, and wherein means for pressing open the valve are provided, comprising a piston which is controllable to a first, second and third position, wherein in the first and third position input means are closed off and in the second position the input means are open, and wherein the third position is situated on a side of the second position remote from the first position.

26. A method according to claim 25, wherein a dispensing device with a dispensing tube is fitted between the connecting device and the at least one valve of the container.

27. An assembly according to claim 25, wherein a dispensing device is provided between the connecting device and the tapping rod, the dispensing device comprising at least part of a beverage dispensing line.

28. An assembly of a container and a connecting device for connecting the container to a pressure source, wherein the container is provided with a tapping rod having therein at least one valve for releasing an input and/or output opening of the container, wherein the connecting device is provided with a housing with first coupling means and the container is provided with a casing with a neck, said neck is secured by a first end on the casing and adjacent the opposite second end is provided with an outwardly extending flange, which defines second coupling means for cooperation with the first coupling means, wherein the tapping rod is secured in the neck, the assembly being such that in coupled condition of the connecting device and the container the first coupling means are at least supported against an underside of the flange proximal to the first end of the neck, and the tapping rod is locked in the neck by at least the connecting device, wherein a dispensing device is provided between the connecting device and the tapping rod, the dispensing device comprising at least part of a beverage dispensing line.

29. An assembly according to claim 28, wherein the dispensing device is detachable from both the tapping rod and the connecting device.

* * * * *